US007134822B2

(12) United States Patent
Parker et al.

(10) Patent No.: US 7,134,822 B2
(45) Date of Patent: Nov. 14, 2006

(54) GUIDE APPARATUS FOR USE IN MAKING A HARDCOVER BOOK

(75) Inventors: Kevin P. Parker, Berkeley, CA (US); Evelyn Steiner, Walnut Creek, CA (US); Wayne Kassom, San Francisco, CA (US)

(73) Assignee: Powis Parker Inc., Berkeley, CA (US)

( * ) Notice: Subject to any disclaimer, the term of this patent is extended or adjusted under 35 U.S.C. 154(b) by 459 days.

(21) Appl. No.: 10/385,960

(22) Filed: Mar. 10, 2003

(65) Prior Publication Data

US 2004/0067123 A1 Apr. 8, 2004

Related U.S. Application Data

(63) Continuation-in-part of application No. 10/262,721, filed on Oct. 2, 2002, now abandoned.

(51) Int. Cl.
*B42C 11/02* (2006.01)

(52) U.S. Cl. ..... 412/19; 412/3; 412/4; 412/9; 412/14; 412/17; 412/18; 412/19; 412/21; 412/28; 281/44; 281/45; 270/52.01; 270/52.07; 270/52.08; 270/52.18; 270/58.07; 270/58.08

(58) Field of Classification Search ..... 270/52.01, 270/52.07, 52.08, 52.18, 58.07, 58.08; 412/3, 412/4, 9, 17–19, 21, 14, 28; 281/44–45
See application file for complete search history.

(56) References Cited

U.S. PATENT DOCUMENTS

| | | | | |
|---|---|---|---|---|
| 1,114,740 A * | 10/1914 | Etheridge | ..... | 412/22 |
| 2,294,347 A | 8/1942 | Bauer | ..... | 154/46 |
| 3,608,115 A * | 9/1971 | Chou et al. | ..... | 412/19 |

(Continued)

FOREIGN PATENT DOCUMENTS

| | | | | |
|---|---|---|---|---|
| CA | 991219 | 6/1976 | ..... | 281/6 |

(Continued)

OTHER PUBLICATIONS

Seal and View ® "Clear Label Protectors" Self Adhesive Stock No. CLL manufactured by Smead, Hastings Minnesota. Admitted Prior Art.

(Continued)

*Primary Examiner*—Boyer D. Ashley
*Assistant Examiner*—Eric A. Gates
(74) *Attorney, Agent, or Firm*—Girard & Equitz LLP

(57) ABSTRACT

A guide apparatus for applying a cover to a bound stack of sheets, including a base unit which defines a book receiving surface and a first alignment member having a lower cover stop disposed along a reference line, and a first upper cover stop also disposed along the first reference line. A first book stop is included defining a stack engaging surface which is positioned intermediate the cover engaging surfaces of the first upper and lower cover stops and with said stack engaging surface extending a distance past said first reference line towards the book receiving surface. The first upper and lower cover stops are positioned to engage top and bottom cover sections of the cover, with the stack engaging surface being positioned to contact the edge of the stack so as to precisely align the stack with respect to the top and bottom cover sections in one direction. A second alignment member includes elements similar to that of the first alignment member so as to precisely the align the stack with respect to the top and bottom cover sections long a second reference line normal to the first reference line.

48 Claims, 23 Drawing Sheets

U.S. PATENT DOCUMENTS

| | | | | |
|---|---|---|---|---|
| 3,715,260 | A | | 2/1973 | Dornemann et al. .... 156/477 B |
| 3,749,422 | A | | 7/1973 | Abildgaard et al. ..... 281/21 |
| 3,816,866 | A | | 6/1974 | Miaskoff et al. ..... 11/3 |
| 3,847,718 | A | | 11/1974 | Watson ..... 161/39 |
| 3,912,304 | A | * | 10/1975 | Abildgaard et al. ..... 281/21.1 |
| 3,964,770 | A | | 6/1976 | Abildgaard et al. ..... 281/29 |
| RE29,105 | E | | 1/1977 | Miaskoff et al. ..... 11/3 |
| 4,126,982 | A | | 11/1978 | Ito et al. ..... 53/593 |
| 4,129,914 | A | * | 12/1978 | Jahn ..... 412/17 |
| 4,184,218 | A | | 1/1980 | Hawkes ..... 11/1 AD |
| 4,299,410 | A | | 11/1981 | Jukola ..... 281/21 R |
| 4,314,716 | A | | 2/1982 | Errichiello ..... 281/29 |
| 4,377,430 | A | | 3/1983 | Bexley et al. ..... 156/184 |
| 4,420,282 | A | | 12/1983 | Axelrod ..... 412/4 |
| 4,496,617 | A | | 1/1985 | Parker ..... 428/55 |
| 4,537,544 | A | | 8/1985 | Joost ..... 412/5 |
| 4,615,541 | A | | 10/1986 | Kwauka ..... 281/29 |
| 4,650,216 | A | | 3/1987 | Carlson ..... 281/34 |
| 4,800,110 | A | | 1/1989 | DuCorday ..... 428/43 |
| 4,898,506 | A | | 2/1990 | Lázár ..... 412/8 |
| 5,044,857 | A | | 9/1991 | Crudo ..... 412/19 |
| 5,052,873 | A | * | 10/1991 | Parker et al. ..... 412/13 |
| 5,066,183 | A | | 11/1991 | Tholérus ..... 412/4 |
| 5,078,563 | A | | 1/1992 | Lolli ..... 412/8 |
| 5,154,447 | A | | 10/1992 | Tooker ..... 281/21.1 |
| 5,174,556 | A | | 12/1992 | Taylor et al. ..... 270/1.1 |
| 5,193,962 | A | | 3/1993 | Parker et al. ..... 412/8 |
| 5,340,155 | A | | 8/1994 | Podosek ..... 281/29 |
| 5,346,350 | A | | 9/1994 | Luhman et al. ..... 412/37 |
| 5,364,215 | A | | 11/1994 | Snellman et al. ..... 412/3 |
| 5,413,447 | A | * | 5/1995 | Rathert ..... 412/19 |
| 5,452,920 | A | | 9/1995 | Parker ..... 281/21.1 |
| 5,569,011 | A | | 10/1996 | Yamaguchi et al. ..... 412/9 |
| 5,601,312 | A | | 2/1997 | Funkhouser ..... 281/21.1 |
| 5,601,915 | A | | 2/1997 | Ochi et al. ..... 428/323 |
| 5,605,425 | A | | 2/1997 | Schaefer ..... 412/4 |
| 5,613,711 | A | | 3/1997 | Parker ..... 281/21.1 |
| 5,779,423 | A | | 7/1998 | Bermingham ..... 412/4 |
| 5,829,938 | A | | 11/1998 | Hartwig et al. ..... 412/8 |
| 5,833,423 | A | | 11/1998 | Yamaguchi et al. ..... 412/8 |
| 5,997,964 | A | | 12/1999 | Klima, Jr. ..... 428/1 |
| 6,024,525 | A | | 2/2000 | Yamanaka ..... 412/36 |
| 6,056,493 | A | | 5/2000 | Hartwig et al. ..... 412/8 |
| 6,065,884 | A | | 5/2000 | Parker et al. ..... 400/611 |
| 6,155,763 | A | * | 12/2000 | Parker et al. ..... 412/6 |
| 6,174,120 | B1 | | 1/2001 | Kalisher ..... 412/1 |
| 6,322,867 | B1 | | 11/2001 | Rush et al. ..... 428/40.1 |
| 6,599,074 | B1 | | 7/2003 | Parker ..... 412/33 |
| 6,619,900 | B1 | | 9/2003 | Cobene, II et al. ..... 412/1 |
| 6,641,345 | B1 | | 11/2003 | Cobene, II et al. ..... 412/1 |
| 6,685,415 | B1 | | 2/2004 | Rush et al. ..... 412/37 |
| 6,709,727 | B1 | | 3/2004 | Parker ..... 428/40.1 |
| 2002/0031630 | A1 | | 3/2002 | Rush, et al. |
| 2002/0064437 | A1 | | 5/2002 | Kuramoto et al. |
| 2004/0066030 | A1 | | 4/2004 | Parker |
| 2004/0120793 | A1 | | 6/2004 | Parker |

FOREIGN PATENT DOCUMENTS

| | | |
|---|---|---|
| JP | 3277698 | 10/1991 |

OTHER PUBLICATIONS

U.S. Appl. No. 09/684,582, filed Oct. 6, 2000, and entitled "Bookbinding Structure and Method".

PCT Publication No. WO 99/39917, Publication Date Aug. 12, 1999.

* cited by examiner

GUIDE APPARATUS FOR USE IN MAKING A HARDCOVER BOOK

CROSS-REFERENCE TO RELATED APPLICATIONS

The present application is a Continuation-In-Part application of Ser. No. 10/262,721 filed on Oct. 2, 2002 now abandoned and entitled Method of Making A Hardcover Book and Hardcover Apparatus.

BACKGROUND OF THE INVENTION

1. Field of the Invention

The present invention relates generally to the field of bookbinding and, in particular, to a guide apparatus for use in making a hardcover book.

2. Description of Related Art

Binding systems for binding stacks of sheets into a book using desktop equipment have increased in popularity. One popular system uses a binder strip having and adhesive surface, such as disclosed in U.S. Pat. No. 4,496,617. The binder strip is typically applied to a stack of sheets to be bound using a desktop binding machine such as disclosed in U.S. Pat. No. 5,052,873. The binding machine carries out the binding operation by suitably positioning the binder strip relative to the stack to be bound and applying heat and pressure so that the edges of the stack are bound. The bound stack does not, however, have the same general appearance as books using commercial binding processes, particularly that of hardcover books.

Various approaches have been used to produce bound books using desktop equipment that closely resembles hardcover books. One example is disclosed in U.S. Pat. No. 6,155,763 that uses specialized covers having an adhesive layer for binding the stack as opposed to using a conventional binder strip. A company located in Finland and believed to be called Instant Cover Europe Ltd has developed another approach. The stack to be bound is first bound together using the above-described binder strips and binding machine. A hardcover is then applied using high tack adhesives. A positioning or guide apparatus is used to assist in the application of the hardcover to the bound stack to ensure that the cover is accurately positioned over the stack. Unfortunately, the positioning apparatus is relatively complex and includes, for example, a mirror to assist in the assembly. A user having little training is likely to have some difficulty in carrying out the binding process.

There is a need for a guide apparatus that enables a user having relatively little training to produce a hardcover book that compares favorably in appearance with commercially bound books.

SUMMARY OF THE INVENTION

A guide apparatus for applying a cover to a bound stack of sheets is disclosed. The apparatus includes a base unit which defines a book receiving surface, a first reference line disposed along a periphery of said book receiving surface and a second reference line, orthogonal to said first reference line, disposed along a periphery of said book receiving surface. A first lower cover stop is provided defining a cover engaging surface disposed along the first reference line, with a first upper cover stop being provided defining a cover engaging surface also being disposed along the first reference line. The cover engaging surfaces of the first lower and upper cover stops are aligned along an axis normal to the book receiving surface. A first book stop is included defining a stack engaging surface, with said stack engaging surface being disposed intermediate the cover engaging surfaces of the first upper and lower cover stops and with said stack engaging surface extending a first distance past said first reference line towards the book receiving surface.

A second lower cover stop is included defining a cover engaging surface disposed along the second reference line, with a second upper cover stop defining a cover engaging surface also being disposed along the second reference line. The cover engaging surfaces of the first and second cover stops are aligned along an axis normal to the book receiving surface. A second book stop is included which defines a stack engaging surface, with said stack engaging surface being disposed intermediate the cover engaging surfaces of the second upper and lower cover stops and with said stack engaging surface extending a second distance past said second reference line towards the book receiving surface.

In use, a cover assembly is positioned on the book receiving surface with edges of the cover assembly engaging the first and second lower cover stops along the orthogonal reference lines. A bound stack is then positioned on the cover assembly, with two orthogonal edges of the stack engaging the respective stack engaging surfaces of the first and second book stops. This results in the stack being precisely aligned with a first half of the cover assembly. Next, a second half of the cover assembly is folded up from the book receiving surface over the stack so as to engage the respective engaging surfaces of the first and second upper cover stops thereby precisely aligning the second half of the cover assembly with respect to the bound stack.

DETAILED DESCRIPTION OF THE INVENTION

Figure 1:
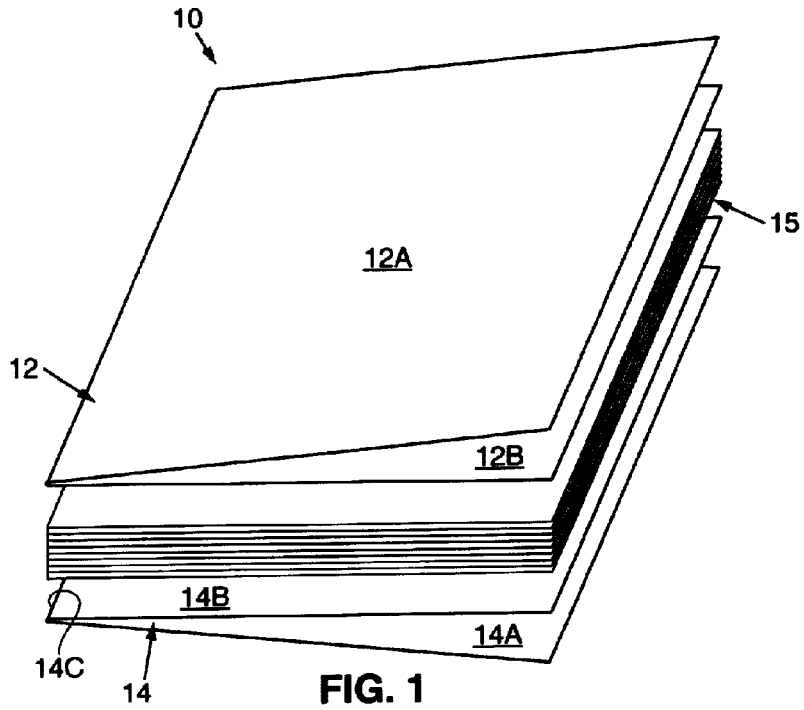
FIG. 1 (PRIOR ART)
FIG. 1 is a perspective view of a stack of sheets to be bound, including the front and back folded liner sheets.

Referring now to the drawings, FIG. 1 shows a stack of sheets 15 to be bound. A first folded liner sheet 12, forming sheets 12A and 12B the same size as the sheets to be bound, is positioned on the top of the stack 15 and a second folded liner sheet 14, forming sheets 14A and 14B, is positioned on the bottom of the stack. The liner sheets 12 and 14 are preferably of a relatively heavy stock as compared to the sheets 15 to be bound. Once the liner sheets 12, 14 and stack of sheets 15 have been assembled, the combined stack 10 is bound together using a conventional binder strip 16 as described in U.S. Pat. No. 4,496,617, the contents of which are hereby fully incorporated by reference into the present application. The actual binding is preferably is carried out using a desktop binding machine as described in U.S. Pat. No. 5,052,873, the contents of which are hereby fully incorporated by reference into the present application. The bound stack 10 is shown in FIG. 2, with the adhesive present in the binder strip 16 operating to bind the individual sheets together and to the paper substrate of the binder strip 16.

Figure 2:
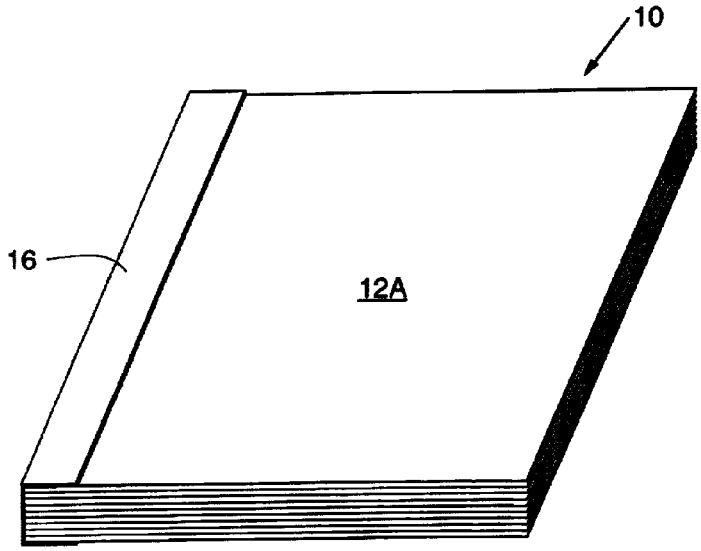
FIG. 2 (PRIOR ART)
FIG. 2 is a perspective view of the stack of sheets of FIG. 1 after binding using a conventional binder strip.
Figure 3:
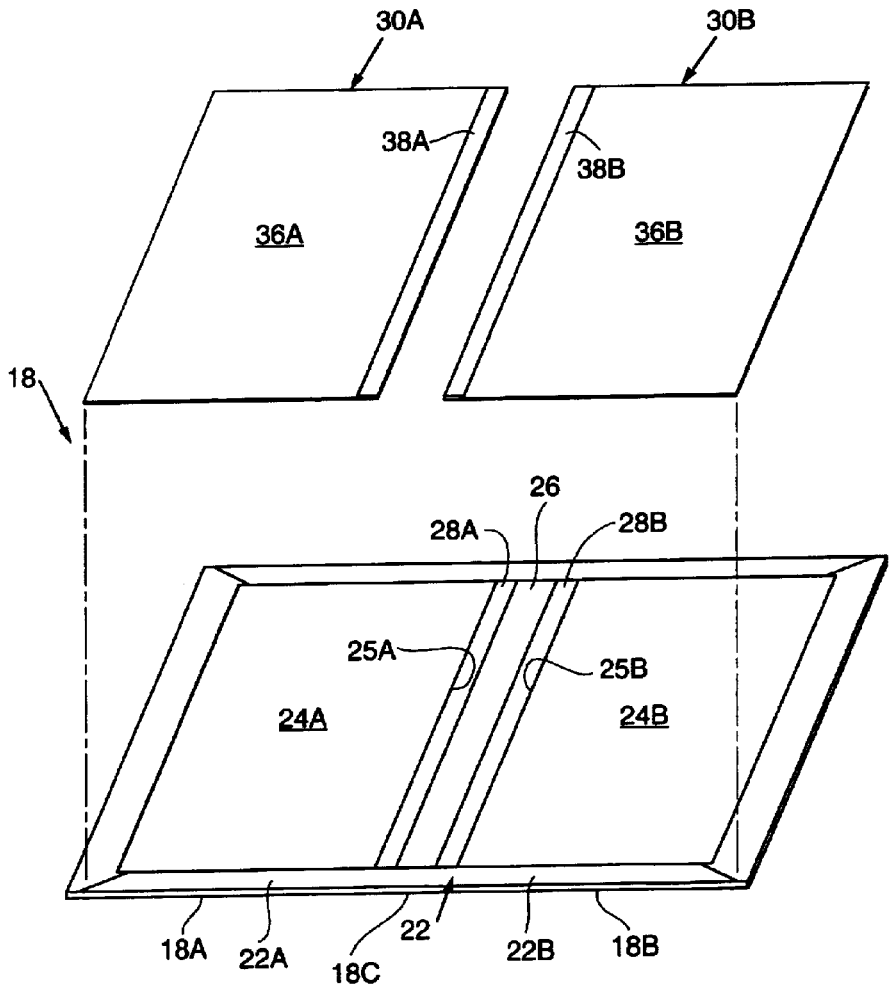
FIG. 3 is a perspective exploded view of the hardcover assembly, with the pressure sensitive front and rear sheets structures shown displaced from the remainder of the assembly.

FIG. 3 shows details of the hardcover assembly 18 that is applied to the bound stack 10 of FIG. 2. Preferably, the cover assembly 18 is completely assembled and sold separately to the user. As will be described, the cover assembly 18 will be manufactured in various sizes to accommodate differing size stacks 10 in terms of stack thickness. It is further anticipated that a user can request that certain information be preprinted on the assembly 18, including title information and any other graphics. As will be described, hardcover assembly 18 includes the front and back cover sections halves 18A and 18B, respectively, separated by a spine section 18C.

The cover assembly includes a pair of relatively stiff cover boards 24A and 24B made of cardboard or the like. The cover boards 24A and 24B are typically 8⅜ inches by 11 5/16 inches for binding 8½ by 11 inch stack 10. The cover boards are covered with a flexible cover membrane 22, typically fabric, which is folded around the edges of the cover boards, as depicted in FIG. 3. That part of the cover membrane 22 disposed intermediate the opposite edges 25A and 25B of the cover boards is unsupported and is thus relatively flexible. A length of paper board is preferably disposed in the spine section 18C of the hardcover assembly 18 so as to slightly stiffen the membrane 22 in that location so that a desired shape is achieved when the bound book is opened and closed. The membrane regions 28A and 28B disposed between the respective edges of the spine section 26 and the respective edges 25A and 25B of the cover boards 24A and 24B are referred to as gutter regions. The gutter regions 28A and 28B are each fixed in width at 7/16 of an inch for A width books and ⅜ of an inch for widths B through F. The gutter regions define the flexible portion of the cover membrane. The spine region 26 varies in width depending upon the width of the stack 10 to be bound. The cover assemblies are preferably prefabricated in various widths to accommodate stacks 10 of various widths as set forth below in Table 1.

TABLE 1

| Model | Spine 26 Width (inches) | Stack Thickness (inches) |
|---|---|---|
| A | 3/8 | To 1/4 |
| B | 5/8 | 1/4 to 1/2 |
| C | 7/8 | 1/2 to 3/4 |
| D | 1 1/8 | 3/4 to 1 |
| E | 1 3/8 | 1 to 1 1/4 |
| F | 1 5/8 | 1 1/4 to 1 1/2 |

The number of available spine widths can be increased or decreased from the values set forth above in Table 1, with a larger number increasing the difficulty of maintaining an adequate inventory and a smaller number detracting somewhat from the appearance of the final product in the spine region.

Figure 4:
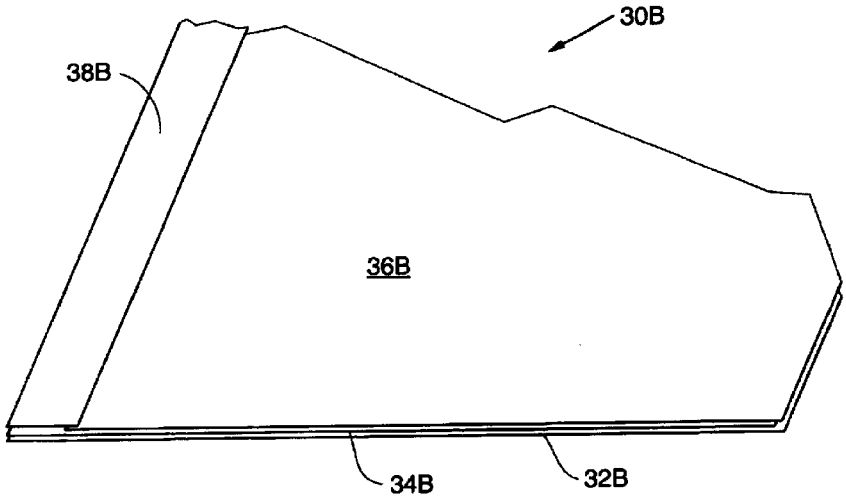
FIG. 4 is a perspective view of one of the two pressure sensitive adhesive sheet structures.
Figure 5:
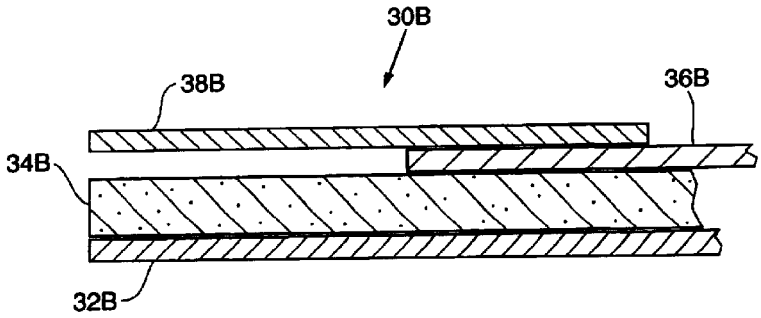
FIG. 5 is a cross-section elevational view of a portion of the adhesive sheet structure of FIG. 4.

Referring back to FIG. 3, the cover assembly 18 is prefabricated using a pair of pressure sensitive adhesive sheets structure 30A and 30B. Further details of the adhesive sheets are also shown in FIGS. 4 and 5. Adhesive sheet structures 30A and 30B are dimensioned 8¼ by 10¾ inches when the stack 10 size is 8½ by 11 inches, to cover the interior periphery of the folded portions of the cover membrane 22A and 22B and to further secure the periphery of the membrane to the respective cover boards 24A and 24B. The smaller size of the underlying sheets 32A and 32B of the sheet structure ensures that the folded liner sheets 12A and 14A completely cover sheets 32A and 32B despite any small misalignment. Each sheet structure includes a respective bottom sheets 32A and 32B and an upper major release liner 36A and 36B. A layer of pressure sensitive adhesive 34A and 34B is disposed intermediate that upper liner and bottom sheet. A pressure sensitive adhesive manufactured by National Starch and Chemical Company and marketed under the designation Instant-Lok, type HL PSA 20-81, has been found suitable for this application. The adhesive layers 34A and 34B are preferably 0.003 to 0.004 inches in thickness.

The upper major release liners 36A and 36B are disposed over a majority of the underlying pressure sensitive adhesive layers. Generally, at least 75% of the adhesive layers are covered by the respective upper major release liners 36A and 36B, with a remaining strip of the adhesive along the inner edge of the sheet structures not being covered by the major release liners 36A and 36B. Instead, upper minor release liners 38A and 38B are disposed over the exposed adhesive strips. This relationship is shown schematically in FIG. 5 (not to scale) where a portion of the sheet structure 30B is depicted. As can be seen, the pressure sensitive adhesive layer 34B is disposed between the bottom sheet 32B and upper major and minor release liners 36B and 38B. That portion of the adhesive layer 34B not covered by the upper major release liner 36 is covered by a separate upper minor release liner 38B. The minor release liner 38B is actually positioned contacting the adhesive layer 34B and is secured in place by the adhesive layer. As is well know, all of the release liners 36A, 38A, 36B and 38B are fabricated from a material that only slightly adheres to the pressure sensitive adhesive so that the release liners can be manually separated from the adhesive without damage to the adhesive or the release liners. As part of the prefabrication of the hardcover assembly, conventional case glue 56 (not depicted in FIGS. 4 and 5) is applied to the top of the cover sections 18A and 18B and to the bottom sheets 32A and 32B. The sheet structures are then positioned over the respective cover sections 18A and 18B as shown in FIG. 3 so that the sheet structures will be secured to the cover sections by the case glue. Thus, the sheet structures 30A and 30B are secured to the cover boards 24A and 24B and to the peripheral portions of the cover membrane 22 by way of the case glue. This completes the prefabrication of the hardcover assembly 18.

Figure 6:
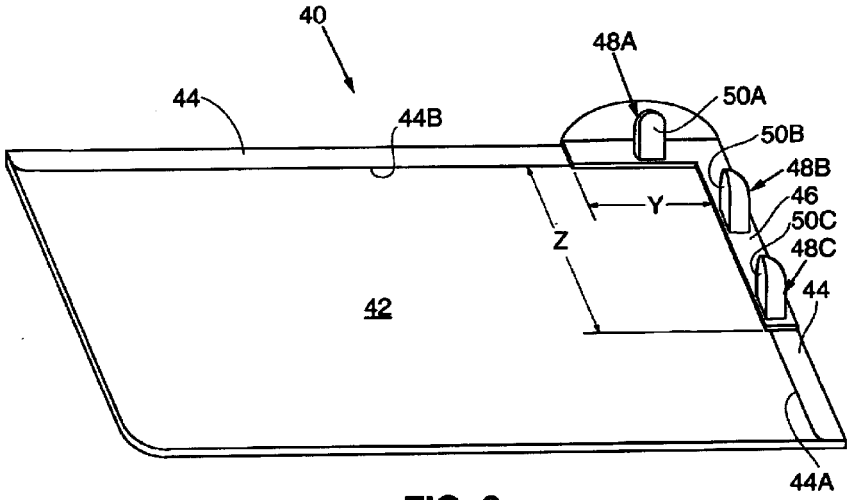
FIG. 6 is a perspective view of a first embodiment of a guide apparatus used to attach the hardcover assembly to the bound stack.
Figure 7:
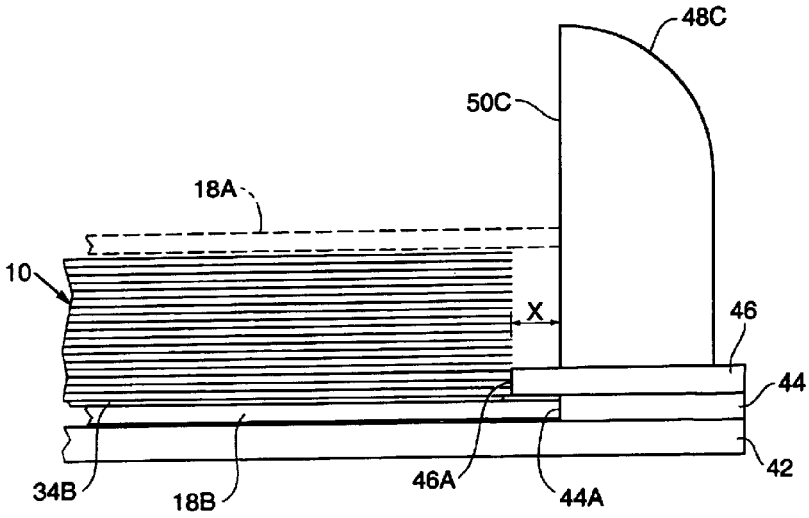
FIG. 7 is an expanded side view of a portion of the guide apparatus of FIG. 6 with a stack to be bound shown in position.

Referring now to FIGS. 6 and 7, a first embodiment guide apparatus 40 is disclosed for use in carrying out the binding process. The guide apparatus includes a flat base member having a receiving surface 42 that is somewhat larger that the largest book to be bound when the book is in the open position. A stop member 44 having two orthogonal segments is supported on the upper surfaced 42 of the base member and extends around two adjacent sides of the base member. A ledge member 46, also having two orthogonal segments, is supported above the stop member 44 and, as can be in FIG. 7, have outer edges 46A which extend past the edge 44A of the stop member a small distance X, with the overhang being typically 0.16 inches. The height of the ledge member above the support surface is great enough to accommodate the thickness of the cover sections 18A and 18B of the cover assembly 18. The ledge member 46 extends along stop member 44 in one direction a distance Y (FIG. 6) which is somewhat smaller than the closed width of the smallest book to be bound. The distance Z, the distance that the ledge member 46 extends along stop member 44 in the other direction, is typically about twice dimension Y.

The guide apparatus 40 also preferably includes two or more vertical stop members, such as 48A, 48B and 48C, with vertical stop member 48A being supported on ledge member 46 about one third of the distance Y of the ledge member from the corner formed by the intersection of the two ledge member 46 segments. Vertical stop member 48B and 48C are at approximate equal distances along the other ledge member 46 segment. As can best be seen in FIG. 7, the vertical stop members each have a planar surface, surface 50C for example, that coincides with the inner edge, edge 44A for example, of the stop member. This configuration also applies to the planar surfaces 50A and 50B of vertical stop members 48A and 48B. Similarly, planar surface 50A coincides with edge 44B of stop member 44, with edges 44A and 44B being orthogonal with respect to one another. Edges 44A and 44B are sometimes referred to herein as the lower cover stops. Vertical stop members 48A, 48B and 48C are sometimes referred to herein as the upper cover stops.

The book binding sequence will now be described, starting with reference to FIG. 8A. The opened hardcover assembly 18 is first positioned on the guide apparatus receiving surface 42, with the upper release liners 36A and 36B facing upwards. As indicated by arrow 52, the hardcover assembly is moved along the surface 42 of the guide apparatus until the edges of cover section 18B is positioned under the ledge member 46, abutting the inner edges 44A and 44B of the stop member 44, as shown in FIG. 7 with respect to edge 44A. Thus, the outer edge 46A of the ledge member 46 will be positioned a fixed distance X from the edge of cover 18B along the full length of both orthogonal segments of the ledge member 46. The outer edge 46A will provide a guide for positioning the bound stack 10, as will be described. Thus, edge 46A will sometimes be referred to herein as a book stop.

Figure 8A:
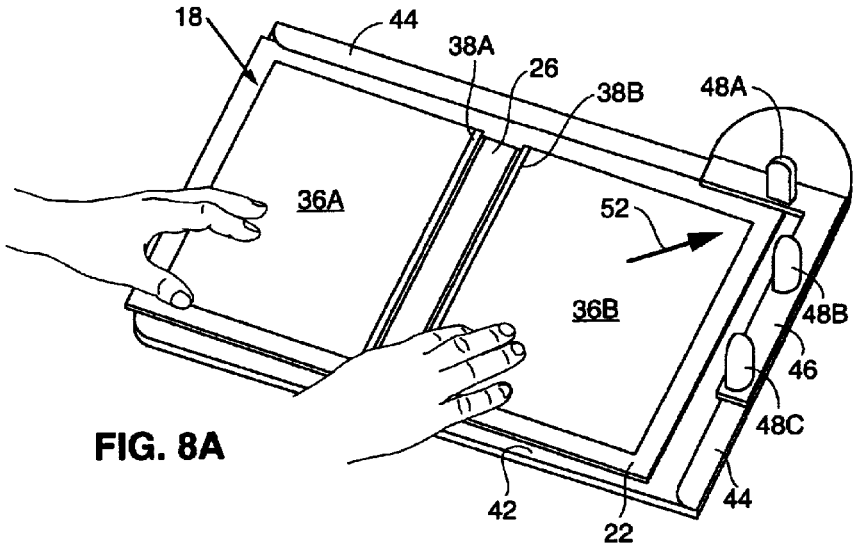
FIGS. 8A–8M depict the process for assembling the bound book.
Figure 8B:
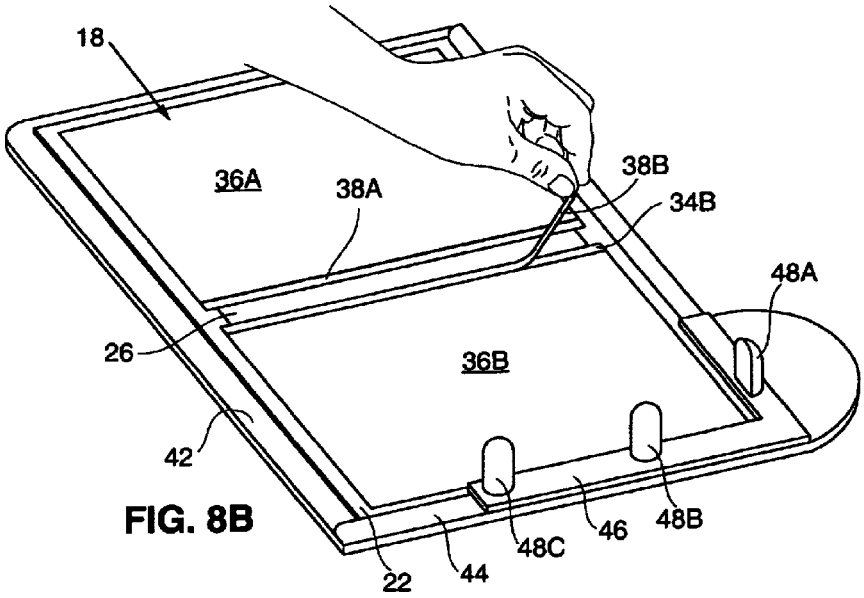
Figure 8C:
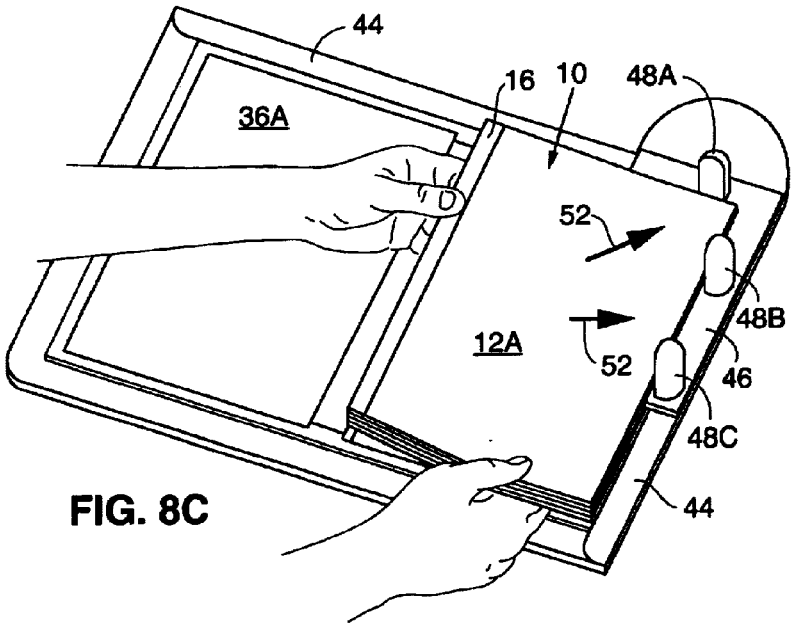
Figure 8D:
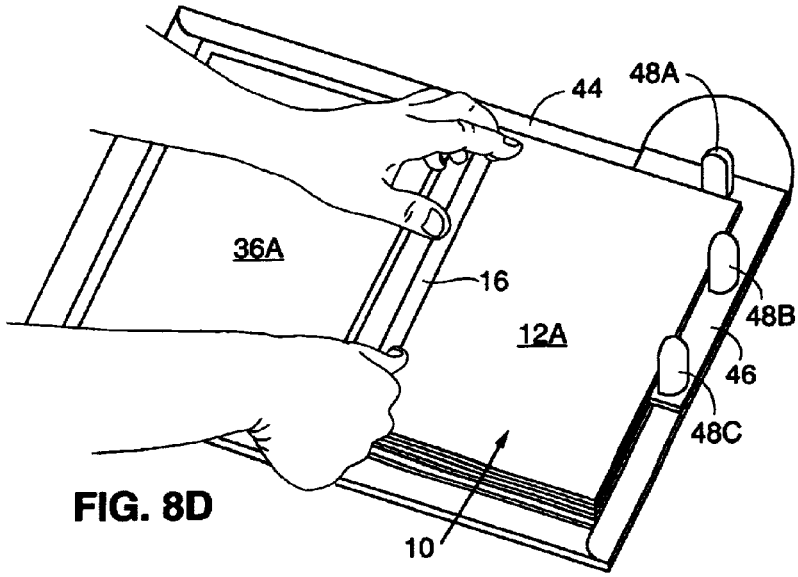

Once the hardcover assembly 18 is properly positioned on the guide apparatus 40, the user manually separates the upper minor release liner 38B as shown in FIG. 8B from the assembly 18. This will expose a relatively narrow strip of the underlying pressure sensitive adhesive 34B adjacent spine region 26. Next, the bound stack 10 is placed over the upper major release liner 36B, with the edges of the stack engaging edge 46A of the ledge member 46 along both orthogonal segments. FIG. 7 shows the edge of stack 10 engaging edge 46A along one of the two segments. As shown in FIG. 8C by arrows 52, that portion of stack 10 along the exposed adhesive 34B is not placed on the exposed adhesive until the orthogonal edges of the stack are positioned against edge 46A of both segments. Once the correct position is achieved, the stack is forced down upon the exposed pressure sensitive adhesive 34B as shown in FIG. 8D. This operates to secure the folded liner sheet 14A of stack 10 to cover section 18B of the hardcover assembly 18 in a correctly aligned position.

Figure 8E:
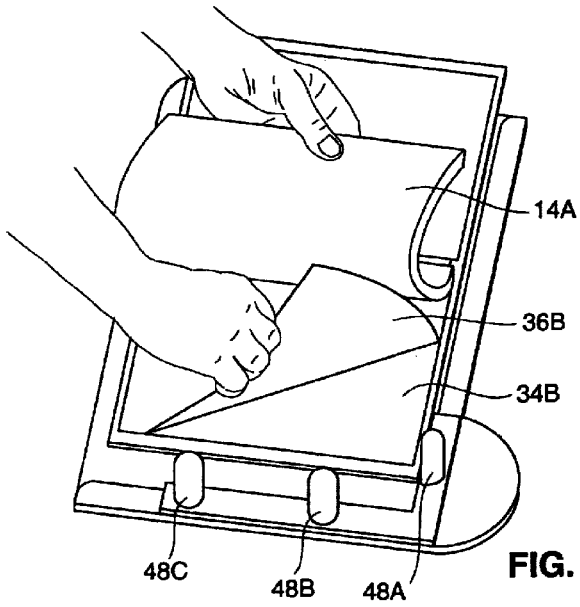
Figure 8F:
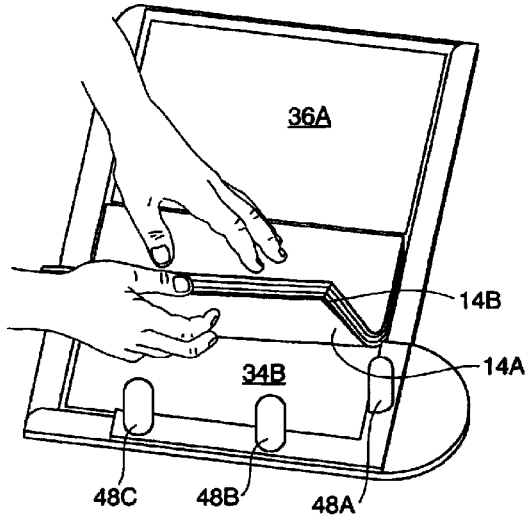
Figure 8G:
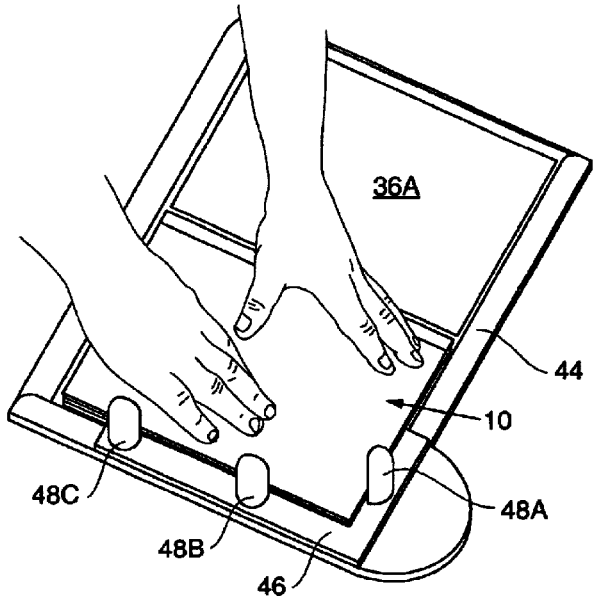

The next step is to secure the remainder of the folded liner sheet 14A of stack 10 to the adhesive 34B of assembly 18. Referring to FIG. 8E, the free edge of stack 10, including liner sheet 14A, is lifted up and rotated away from the upper major release liner 36B. This permits the release liner 36B to be separated from the hardcover assembly 18 thereby exposing the remainder of the pressure sensitive adhesive 34B. As shown in FIG. 8F, the spine portion of stack 10 held down against the hardcover assembly 18 with one hand while stack 10 is rotated over the adhesive 34B with the other hand. As shown in FIG. 8G, the user then presses the stack 10 down on the hardcover assembly 18. This causes the remainder of the liner sheet 14A of the stack to be secured by the remainder of adhesive 34B to cover section 18B of the hardcover assembly 18. The second cover section 18A of the hardcover assembly will now be attached.

Figure 8H:
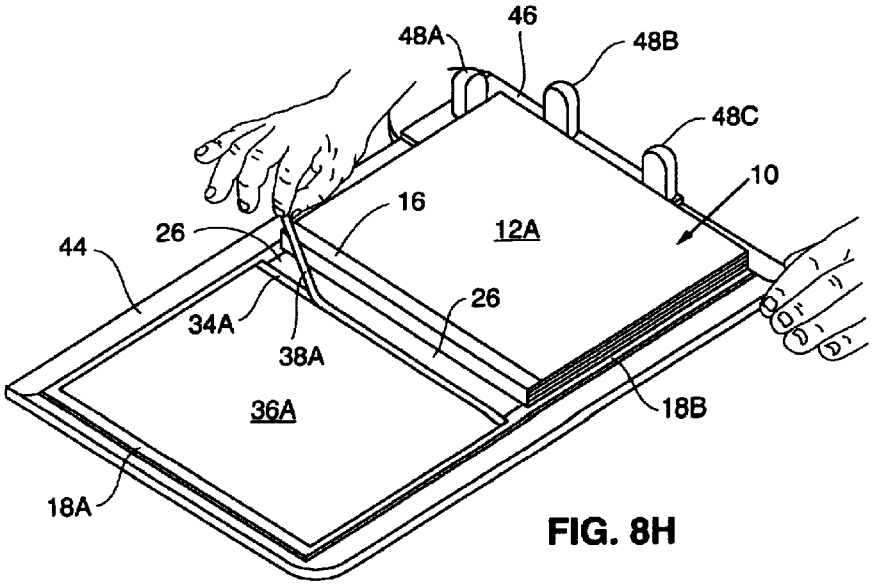
Figure 8I:
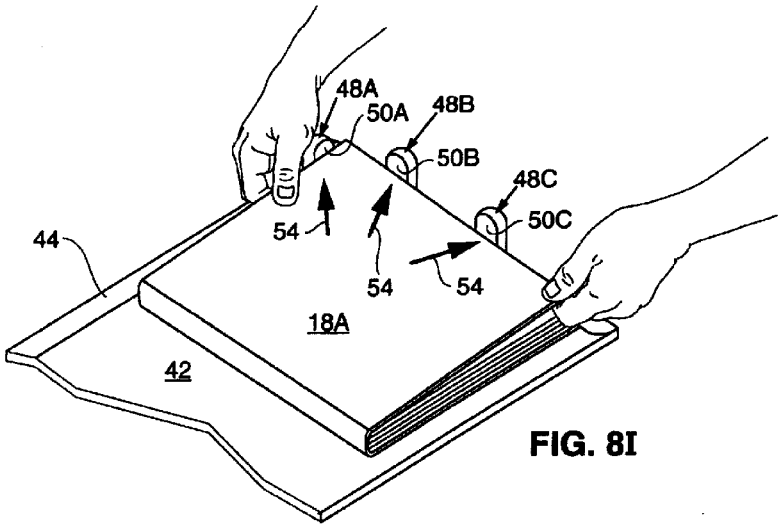
Figure 8J:
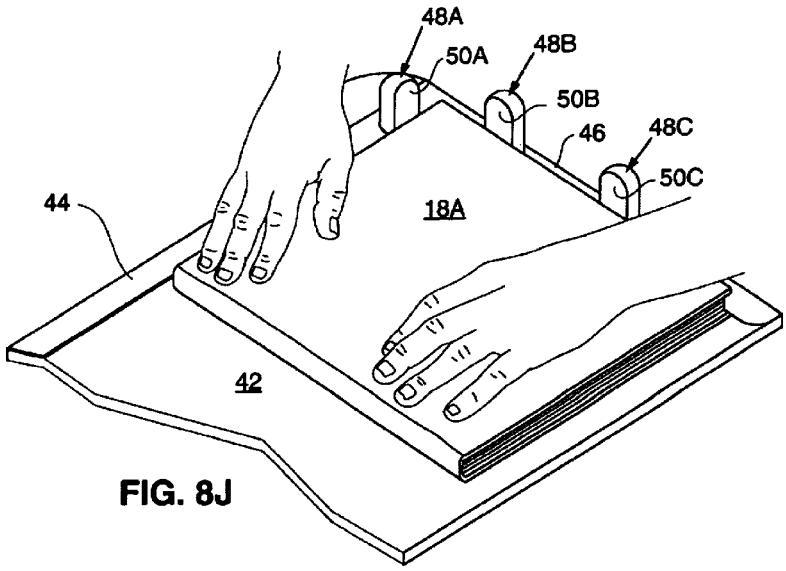

Referring to FIG. 8H, the upper minor release liner 38A is next separated from the hardcover assembly 18 thereby exposing a strip of pressure sensitive adhesive 34A adjacent spine region 26. The user then lifts the cover section 18A of the hardcover assembly away from the surface 42 of the guide apparatus and rotates the cover 18A around the spine. As indicated by arrows 54 of FIG. 8I, the cover section 18A is positioned so that the edges of the cover section 18A contact the planar surfaces 50A, 50B and 50C of the respective three vertical stop members 48A, 48B and 48C. This is shown in phantom in FIG. 7. The hardcover assembly 18 is then positioned correctly with respect to the bound stack 10. The user then forces the cover section 18A down as shown in FIG. 8J so that an edge of folded liner sheet 12A of stack 10 is secured to the hardcover assembly 18 by way of the exposed strip of adhesive 34A.

Figure 8K:
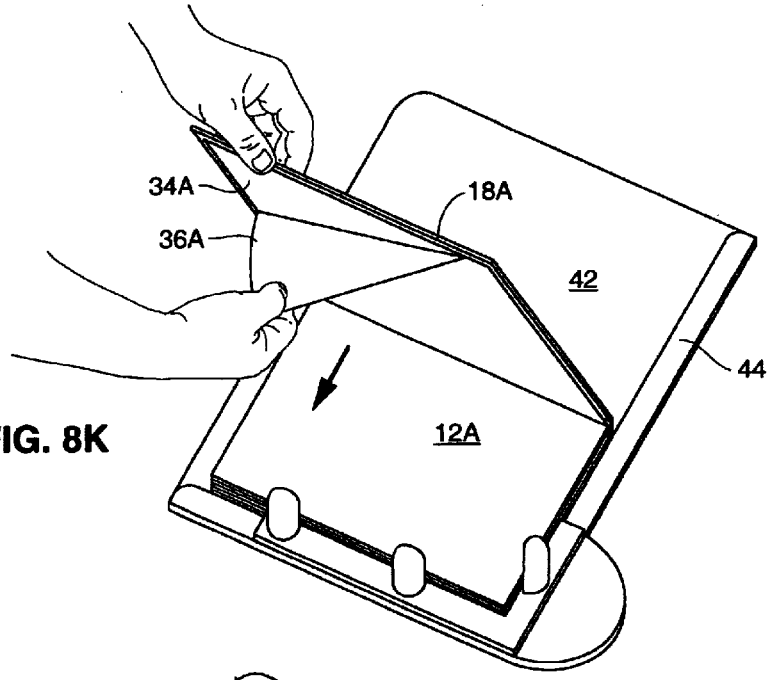
Figure 8L:
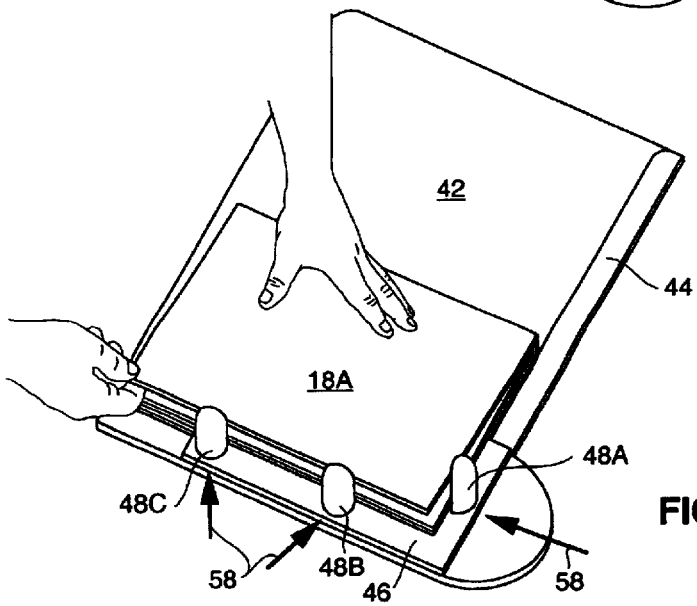
Figure 8M:
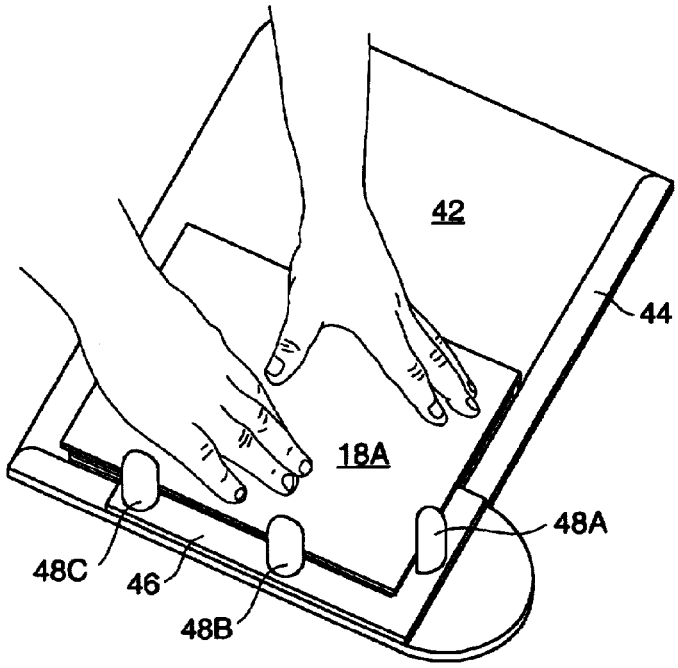

As shown in FIG. 8K, the user then lifts cover section 18A up and rotates the cover away from stack 10, with a narrow strip of liner sheet 12A of the stack remaining secured to cover section 18A. This permits upper major release liner 36A to be separated from hardcover assembly 18 thereby exposing the remainder of pressure sensitive adhesive layer 34A. Cover 18A is then placed rotated back down onto stack 10, where the edges of the cover should again be in contact with the surfaces 50A, 50B and 50C of the respective stops 48A, 48 and 48C as shown in FIG. 8L by arrows 58. The user then presses down on cover section 18A as shown in FIG. 8M thereby securing the cover section 18A to folded liner sheet 12A of stack 10. This completes the binding sequence.

Figure 9A:
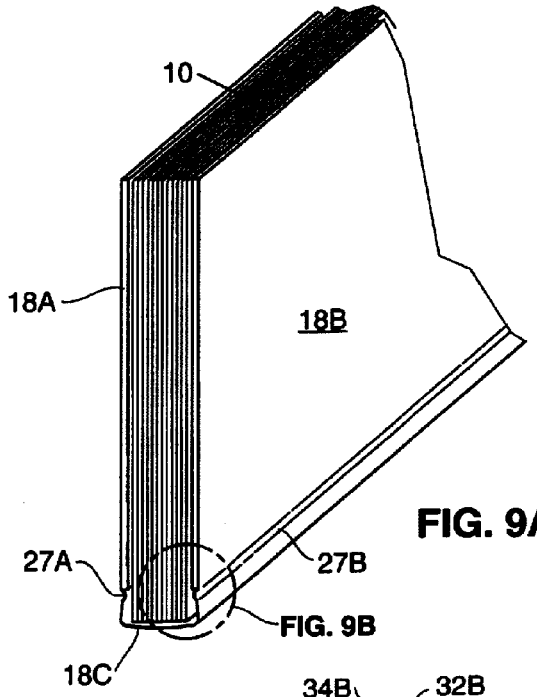
FIGS. 9A and 9B are perspective views of portions of the completed book.
Figure 9B:
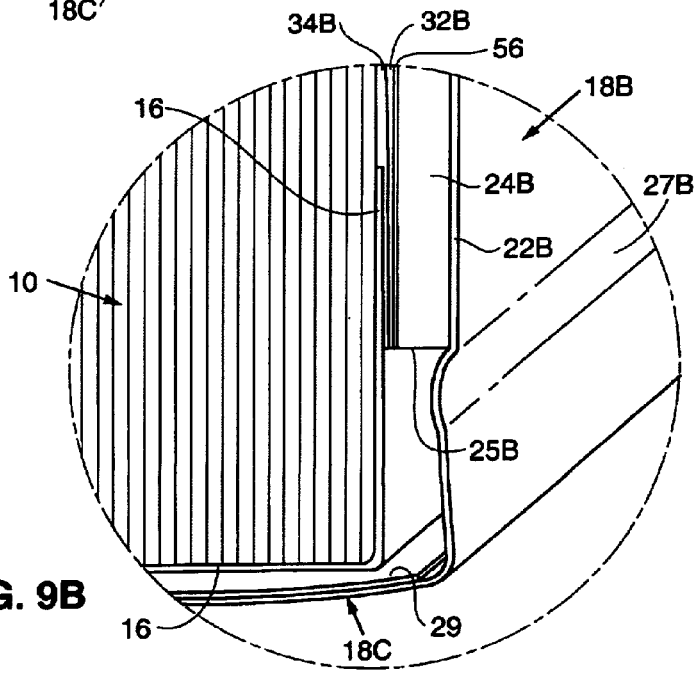
Figure 10:
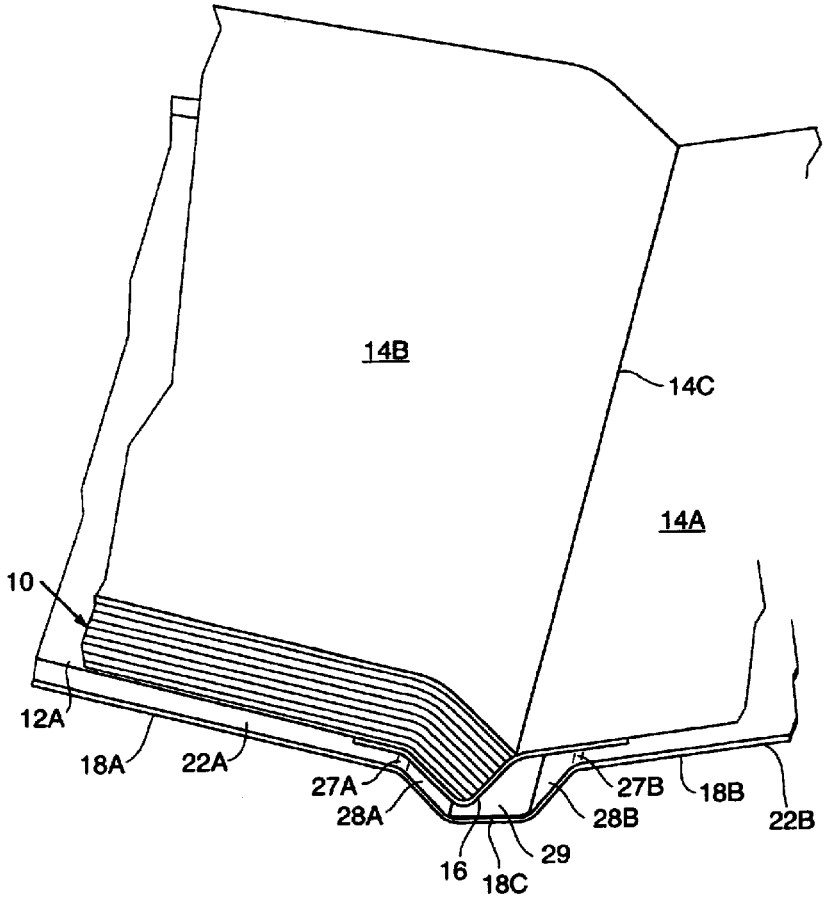
FIG. 10 is a perspective broken view of the completed book shown in an open position.

FIGS. 9A and 9B show the completed book in a closed position and FIG. 10 shows the book in an opened position, at the last page of the book, so that folded liner sheets 14A and 14B are depicted. Sheet 14A is secured to hardcover section 18B by way of adhesive 34B and sheet 12A at the front of the book (not depicted) is secured to hardcover section 18A by adhesive 34A. The region between the binder strip 16 and the spine region 18C is not attached so that, when the book is opened as shown in FIG. 10, the spine region does not attempt to fold with the binder strip 16. Thus, the book will lay flat when opened and will not tend to fold shut. Further, the spine region 18C will not distort when the book is opened to the same degree it would if the spine region 18C was attached. As previously noted, a paper board strip 29 is positioned in the spine region intermediate the gutter regions 28A and 28B (FIG. 3) so as to hold the shape of the spine region 29 when the book is opened and closed. Fold lines 27A and 27B are formed naturally in the membrane 22 in the regions near the edges 25A and 25B of the cover boards thereby further enhancing the appearance of the final product.

Figure 11:
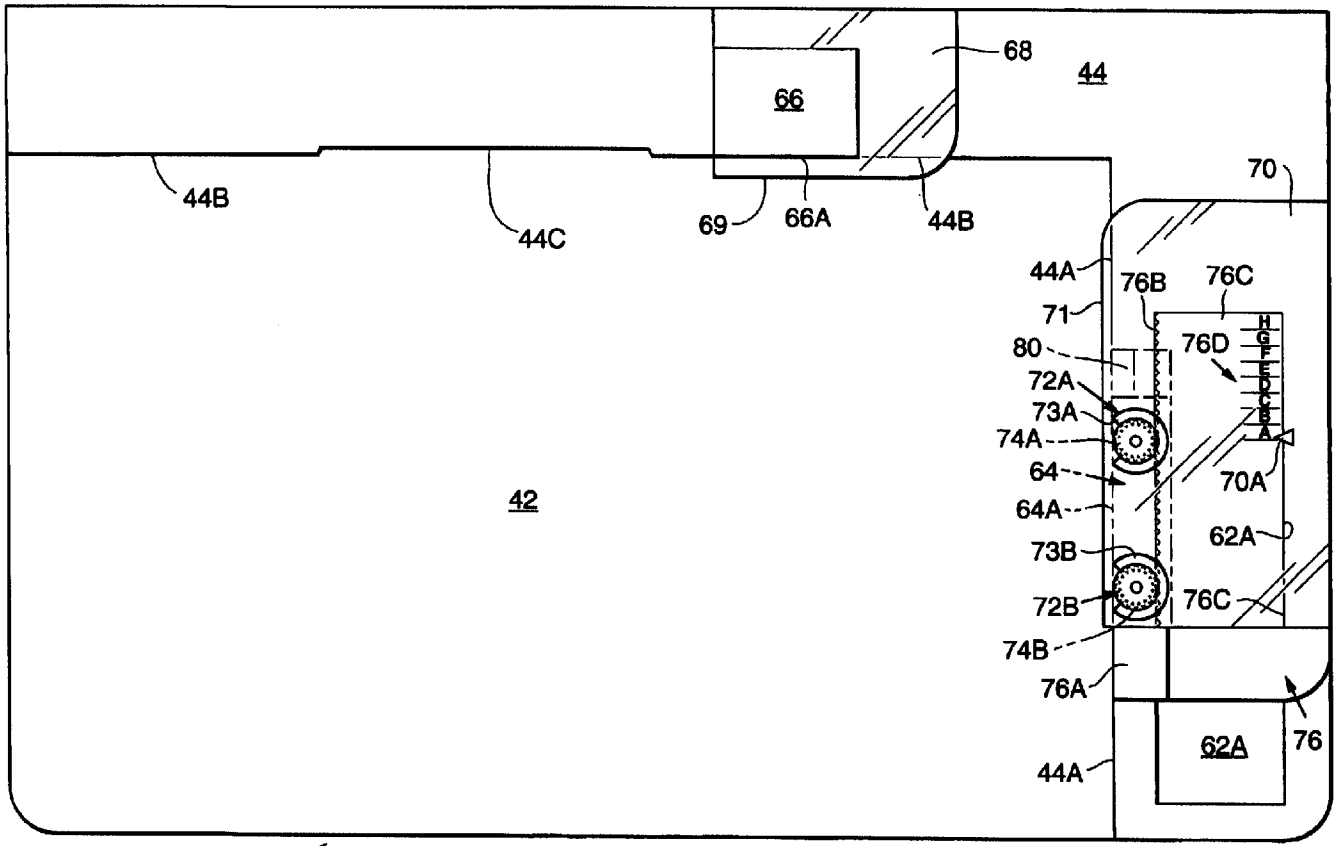
FIG. 11 is a plan view of a second embodiment guide apparatus in accordance with the present invention.
Figure 12:
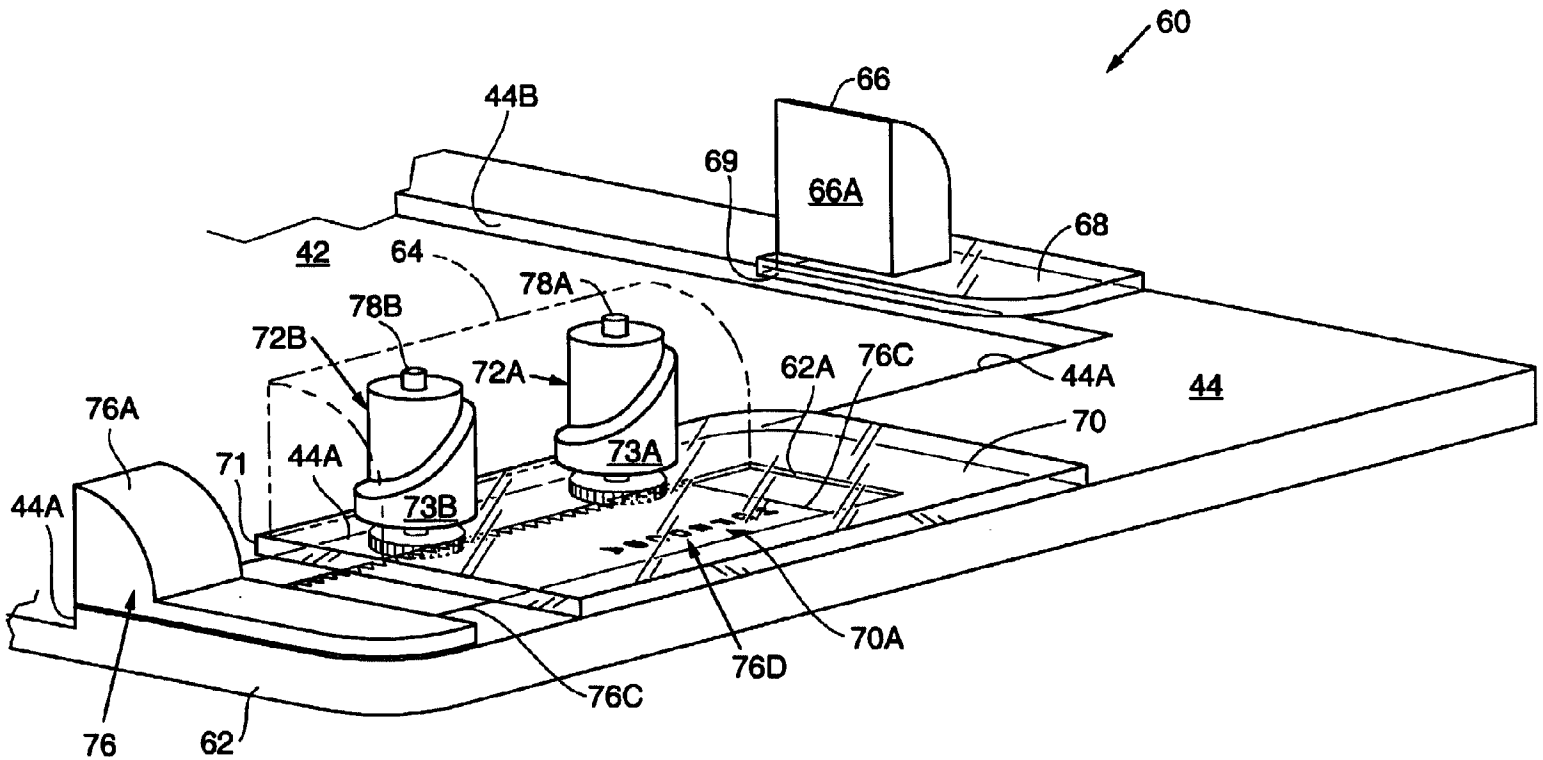
FIG. 12 is a perspective view of part of the second embodiment guide apparatus.

Referring now to FIGS. 11 and 12, a second embodiment of a guide apparatus 60 in accordance with the present invention may be seen. The guide apparatus has selected features that further enhance the first embodiment guide apparatus 40 of FIG. 6. Guide apparatus 60 includes a base member 62 having a book receiving surface 42 similar to that of the first embodiment apparatus 40. A stop member 44, which defines a pair of orthogonal edges 44A and 44B, extends around the periphery of the receiving surface 42, similar to edges 44A and 44B of the first embodiment guide apparatus. A transparent plastic book stop 70 is positioned along edge 44A and extends over the edge in much the same manner as ledge member 46 of the first embodiment apparatus. An elongated vertical cover stop member 64, also shown in phantom in FIG. 12, is disposed over book stop 70, with cover stop member 64 having a surface 64A that is coincident with edge 44A. Elongated vertical cover stop member 64 provides the same function as vertical stop members 48C and 48B of the first embodiment guide apparatus shown in FIG. 6, in addition to providing further functions.

A second book stop 68 is provided in the second embodiment apparatus along edge 44B and which extends out over the edge the same distance that stop 70 extends over edge 44A. Book stop 68 is also preferably made of transparent plastic so as to match stop 70 in appearance. A vertical cover stop member 66 is disposed over book stop 68, and has a surface 66A that coincides with edge 44B. Vertical cover stop member 66 provides the same function as vertical stop member 48A of the first embodiment guide apparatus of FIG. 6.

Figure 13:
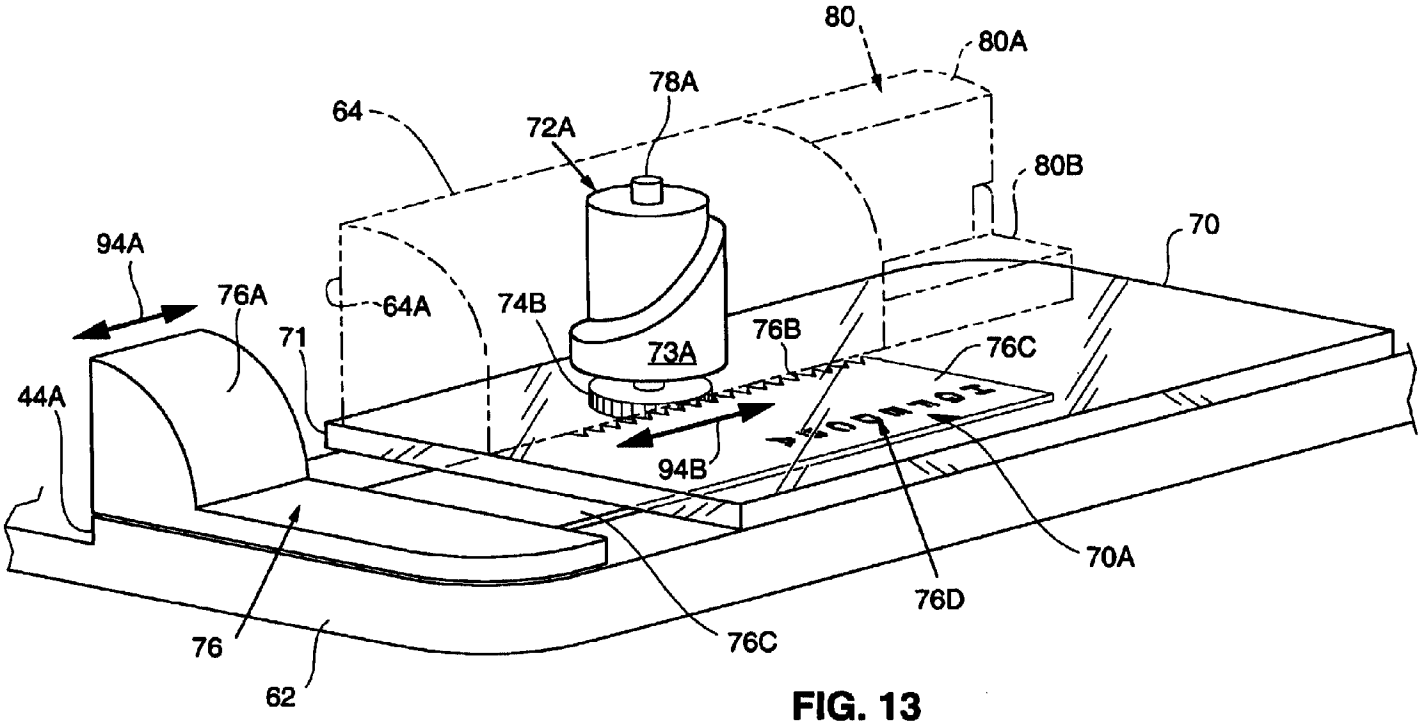
FIG. 13 is a perspective view of part of the second embodiment guide apparatus using a single spiral cylinder and showing some of the details of the manner in which the position of a slide member controls rotation of the spiral cylinder.

As can also be seen in FIGS. 12 and 13, the guide apparatus includes a mechanism built into elongated vertical cover stop 64 that provides additional support for the stack 10 when the hard cover assembly 18 is applied to the stack. This mechanism includes a pair of spiral cylinders 72A and 72B in FIG. 12 and a single spiral cylinder 72A in FIG. 13. Referring back to FIG. 7, an exemplary stack 10 is shown resting on the first embodiment guide assembly 40. Stack 10 is properly positioned relative to the cover assembly 18, including cover sections 18A and 18B, with the edges of the cover sections abutting the planar surface 50C of vertical stop 48C and with the edge of the stack abutting ledge member 46A. The stack 10 of FIG. 7 is a relatively thick stack so that the ledge member 46A only abuts the stack in a small region along the height of the stack. As a consequence, when the stack 10 is pressed against the ledge member 46A to ensure proper positioning, the stack will have a tendency to shingle. In other words, the edge of the stack 10 will not be vertical, with the upper portion of the stack being closer to the planar surface 50C than the lower portion. This misalignment will detract from the appearance of the final bound book. It would be possible to increase the thickness of the ledge member 46A so that the edge of the stack 10 is supported along more of the height of the stack, thereby reducing the tendency of the stack to shingle. However, a thicker ledge member 46A will tend to contact cover section 18A for stacks 10 that are relatively thin, thereby preventing the apparatus from being usable for thinner stacks.

Figure 16:
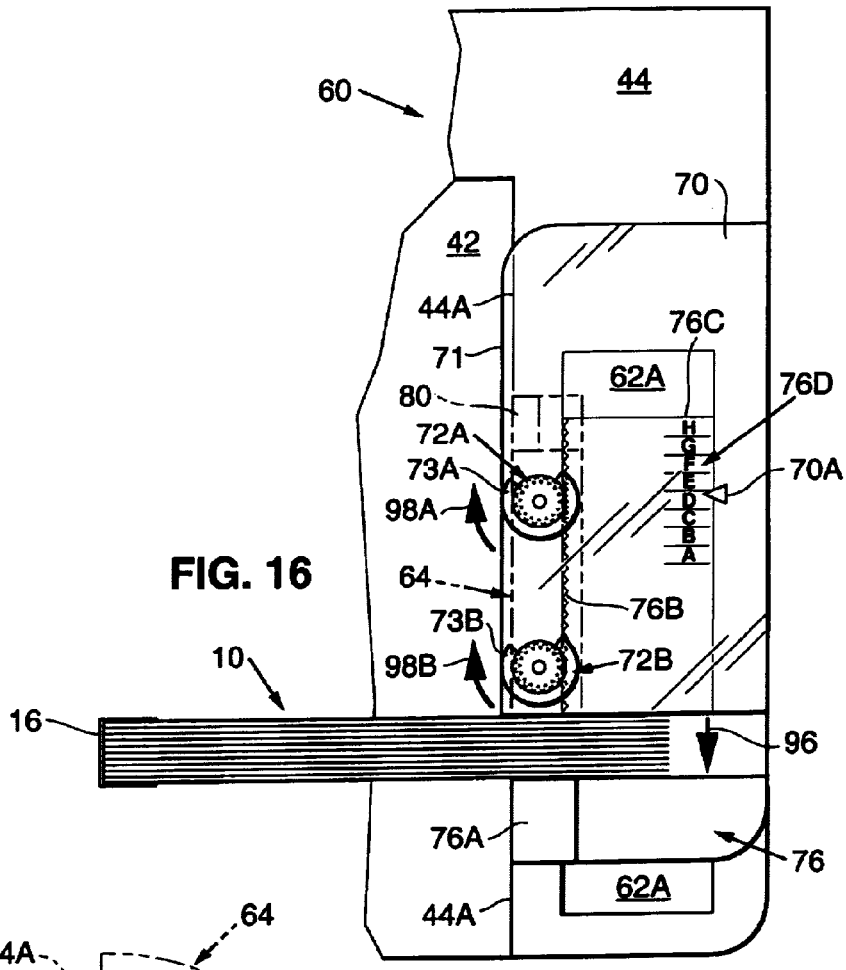
FIG. 16 is a partial plan view illustrating the manner in which the thickness of a book to be bound controls the rotational position of the spiral cylinders.

Referring back to FIGS. 11, 12 and 13, the second guide apparatus 60 includes a movable slide member 76 having an extension section 76C disposed in a recess 62A formed in base member 62 below transparent book stop 70. Slide member 76 further includes a grip member 76A connected to one end of the extension section 76C which permits the slide member 76 to be manually translated within recess 62A as indicated by arrows 94A and 94B of FIG. 13. Extension section 76C includes markings "A" through "H" that are visible below transparent book stop 70 and which pass below a pointer indicia 70A printed on the stop. In operation, a stack 10 to be covered is positioned between one end of vertical cover stop 64 and grip member 76A as shown in FIG. 16, with the grip member being translated by a user so that the spacing between the stop 64 and the grip member 76A corresponds to the thickness of the stack 10. The positioning of the stack 10 and the placement of grip member 76A adjacent the stack as described, causes a selected one of the markings "A" through "H" on the translated extension section 76C to be disposed below fixed pointer indicia 70A. The markings "A" through "H" are positioned and calibrated such that a user can then select a hard cover assembly 18 of appropriate dimensions as set forth in Table 1, above. Although FIG. 16 shows the stack 10 positioned with the binder strip 16 not disposed between the end of stop 64 and grip member 76A for purposes of illustration, it is preferable that the stack be positioned on the guide apparatus with the strip at the bottom of the stack so that the thickness added by the binder strip and associated adhesive is taken into account in the measurement.

As can best be seen in FIGS. 11 and 12, one or two rotatably mounted spiral cylinders 72A/72B are mounted within elongated vertical cover stop 64. Cylinders 72A/72B are secured in place by vertical shafts 78A/78B. A gear or pinion 74A/74B is disposed below each of the respective cylinders. The pinions 74A/74B engage a rack 76B formed on an edge of extension section 76B of the slide member 76 so that translation of the slide member causes the cylinders to rotate about respective shafts 78A/78B. If a very thin stack 10 is to be bound, the grip member 76A of the slide member 76 is positioned proximate the edge of vertical cover stop 64 as shown in FIG. 11 so that the marking "A" will be positioned below pointer 70A. This indicates that a hard cover assembly type "A" is to be used as shown in Table 1, above. The spiral cylinders 72A/72B each include a spiral shaped engaging surface 73A/73B that extends around approximately three quarters of the circumference of the respective cylinder. Surfaces 73A/73B sometimes extend past the surface 64A so as to engage the edge of the stack depending upon the rotational position of the cylinders 72A/72B. When the cylinders are rotated as shown in FIG. 11 for example, the position for a very thin book, the stack engaging surfaces 73A/73B are rotated away so that the engaging surfaces do not extend past the surface 64A of the elongated vertical cover stop 64. In that event, the edge of the stack 10 would abut the edge 71 of book stop 70, just as the edge of stack 10 abuts edge 46A as shown in FIG. 7 with the first embodiment guide apparatus. In that the stack 10 is narrow, shingling is not an issue since edge 71 will provide adequate support along substantially the full height of the stack.

Figure 17:
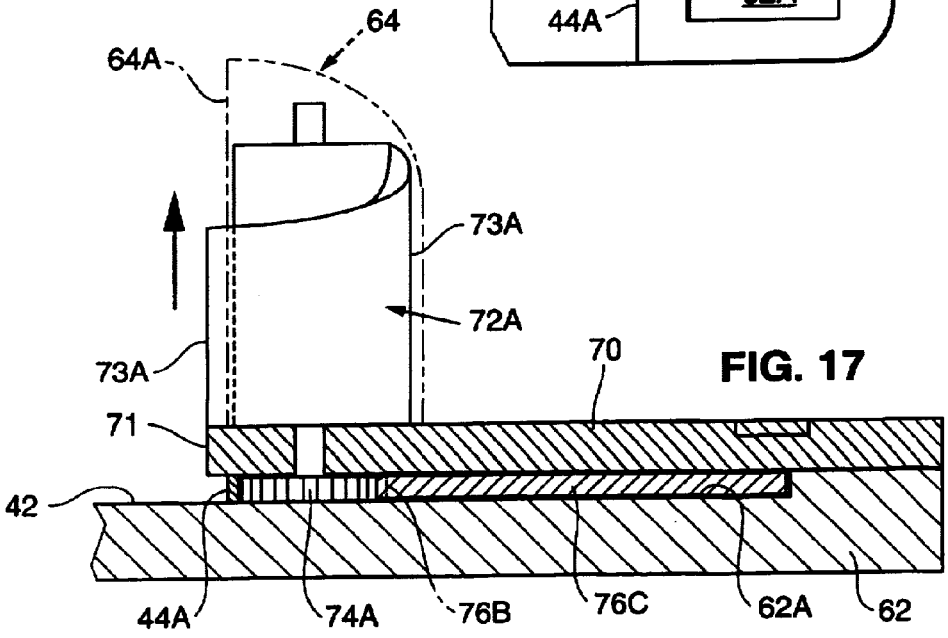
FIG. 17 is a partial elevational view showing more details of the rotational position of one of the spiral cylinders of FIG. 16.
Figure 18:
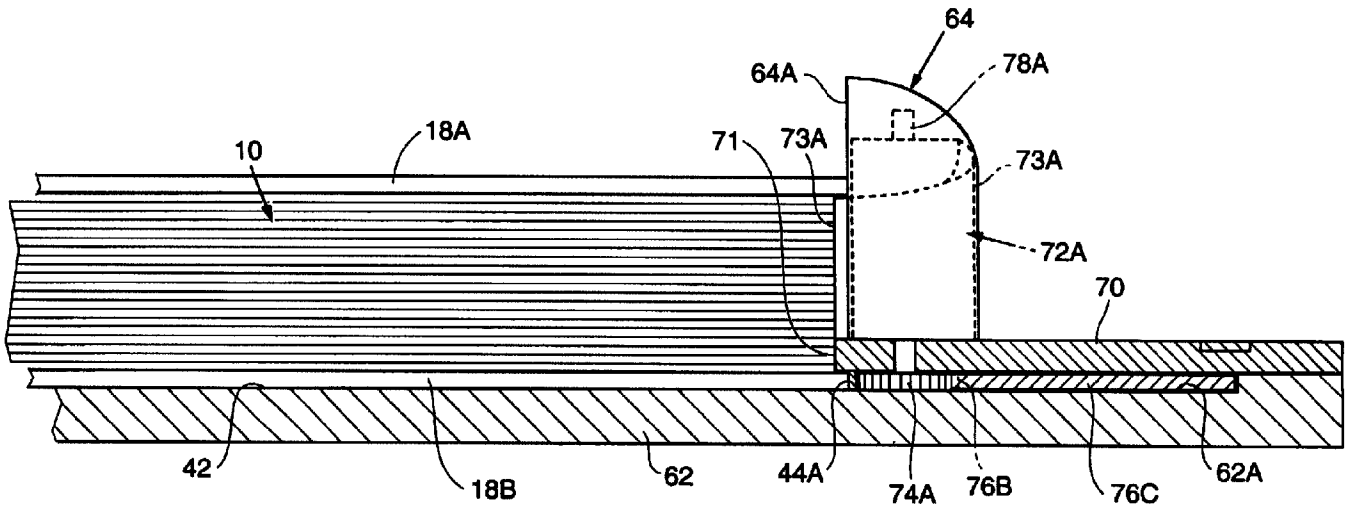
FIG. 18 shows a relatively thick book positioned on the second embodiment guide apparatus.

Referring now to FIGS. 16, 17 and 18, if a thicker stack 10 is to be covered, the spiral cylinders will be rotated such that the engaging surfaces 73A/73B will extend past the surface 64A of the vertical cover stop 64 and to a point that coincides with edge 71 of book stop 70. Further, the height of the engaging surfaces 73A/73B will tend to match the thickness of the stack 10. This is accomplished by positioning the stack 10 between grip member 76A and the end of the vertical cover stop 64 so that the spacing between the two elements corresponds to the thickness of the stack. As can be seen in FIG. 16, the exemplary stack 10 has a thickness that results in marking "E" to be positioned below pointer indicia 70A. As indicated by Table 1, above, the user will select the appropriate size hardcover assembly 18. In addition, movement of the rack member 76B, as indicated by arrow 96, which drives respective pinions 74A/74B, will cause the associated spiral cylinders 72A/72B to be rotated a selected amount as indicated by respective arrows 98A/98B. The amount of rotation is related to the spacing between grip member 76A and the end of stop 64, the thickness of the stack 10. This amount of rotation causes the engaging surfaces 73A/73B to extend away from surface 64A to a point where the surfaces coincide with edge 71 as shown in FIGS. 17 and 18 and such that the height of the extended engaging surfaces, including the extended surface of edge 71, corresponds to the thickness of the stack 10. Thus, maximum support is provided to the edge of the stack 10 by the extended surfaces 73A/73B, while leaving sufficient clearance so that the top cover section 18A (FIG. 18) is free to engage surface 64A and the bottom cover section 18B can engage edge 44A of stop member 44.

Thus, it can be seen that by simply placing the edge of the stack 10 to be covered in the appropriate position on the guide apparatus 60, the user is informed of the appropriate size hard cover assembly 18 to be used. In addition, the requisite degree of mechanical support needed to keep the stack 10 from shingling is provided automatically by the rotating spiral cylinders 72A/72B.

Figure 14:
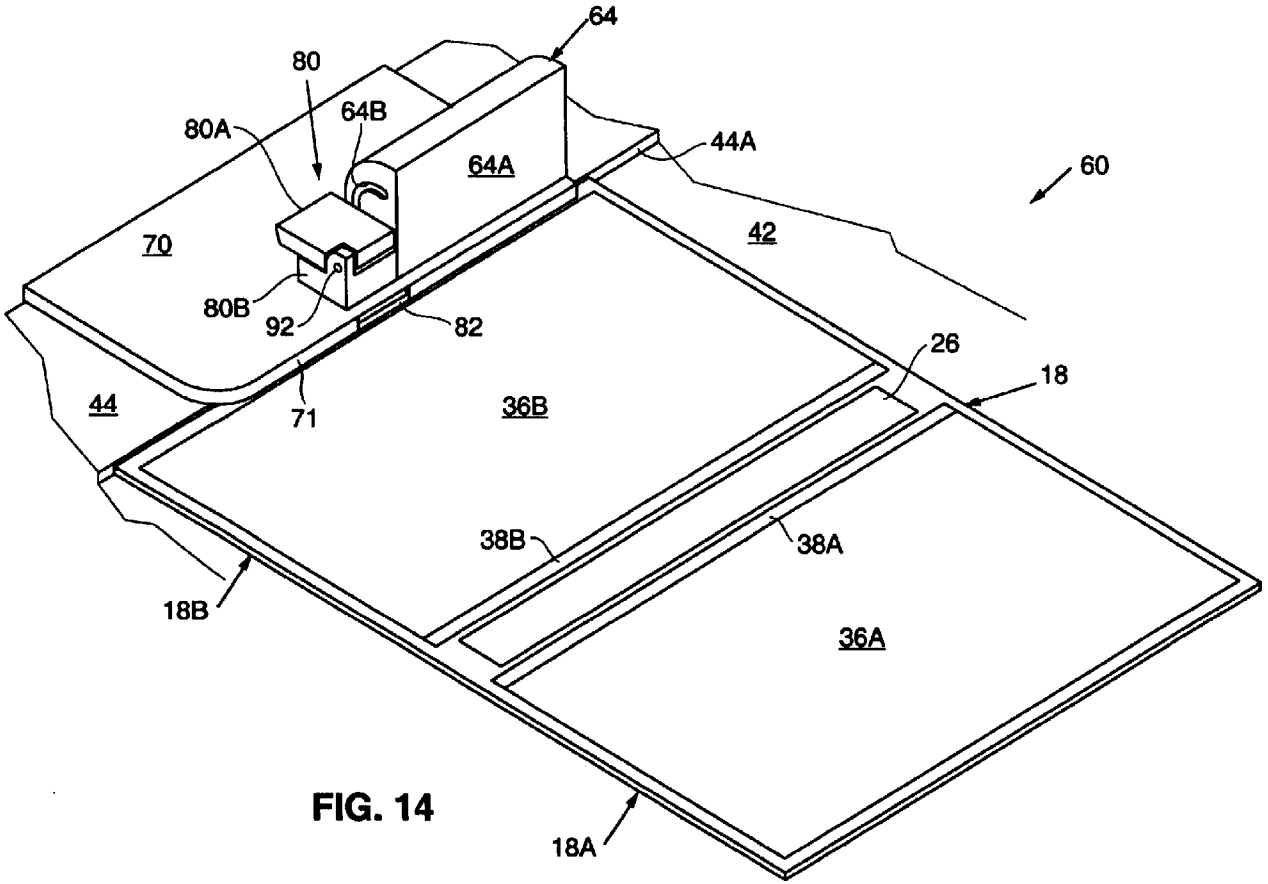
FIG. 14 is a perspective view of part of the second embodiment guide apparatus showing some of the details of a cover clamp mechanism.
Figure 15A:
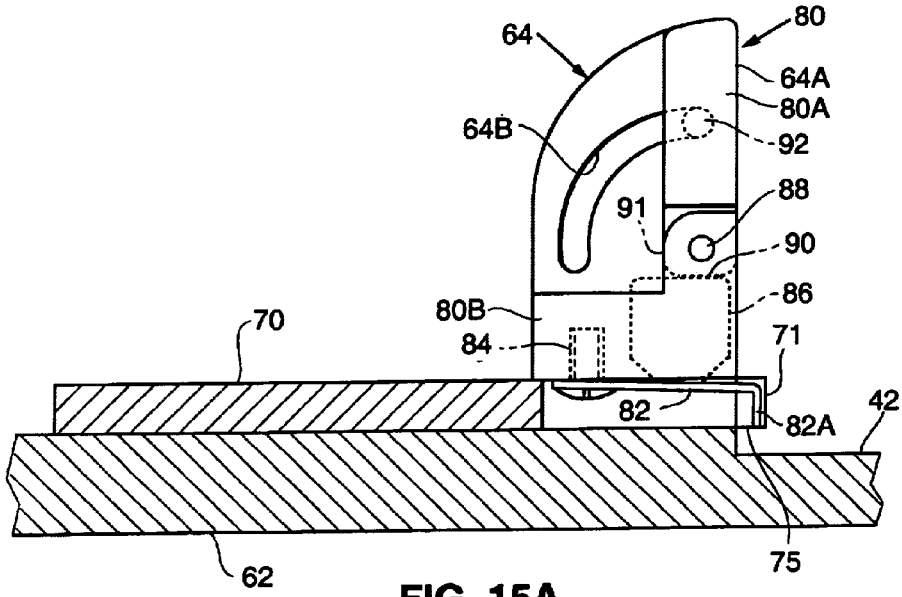
FIGS. 15A and 15B are cross-sectional side views of the cover clamp mechanism in the open and closed positions, respectively.
Figure 15B:
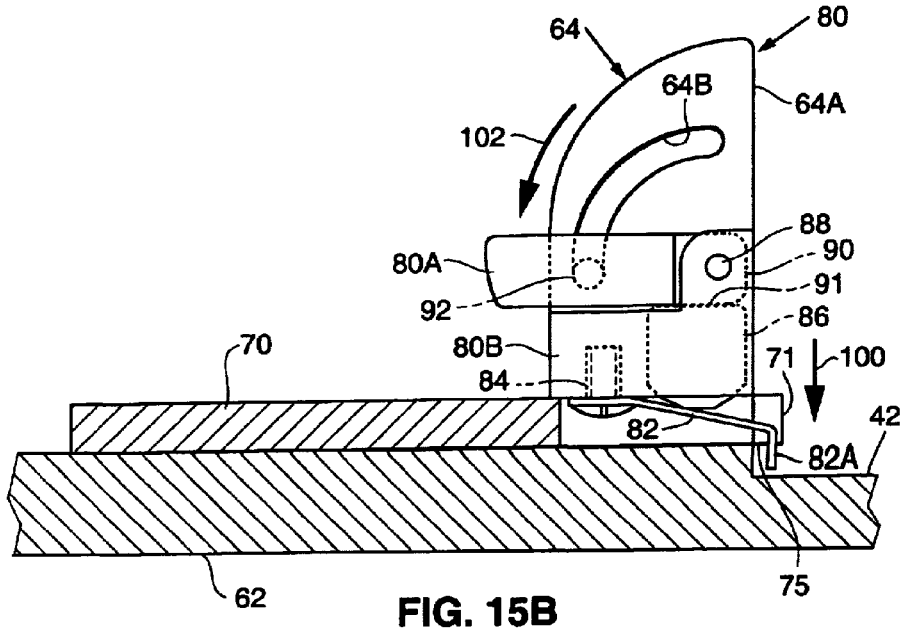

In order to further assure accurate positioning of the hardcover assembly 18 on the bound stack 10, the second embodiment guide apparatus 60 can further include a cover clamp mechanism 80 which grips the hard cover section 18B and reliably secures the hard cover assembly 18 to the guide apparatus. Referring primarily to FIGS. 14, 15A and 15B, the cover clamp mechanism 80 is preferably an integral part of the elongated vertical cover stop 64. (Note that FIG. 14 does not show some of the structure of the guide apparatus not related to the clamp mechanism, including the spiral cylinders 72A/72B and the slide member 76. Further, FIG. 12 does not show the clamp mechanism.) As can best be seen in FIGS. 15A and 15B, the cover clamp mechanism 80 includes a cantilevered spring metal contact member 82 secured to the underside of a base member 80B by way of screw 84. Base member 80B is preferably an integral part of vertical cover stop 64. Contact member 82 is disposed in a recess (not shown) in base member 80B so that the member is free to move between a clamping position as shown in FIG. 15B and a retracted position as shown in FIG. 15A.

The clamp mechanism 80 includes a lever 80A that is rotatably mounted on the vertical cover stop 64 by way of a shaft 88 between a clamping and a non-clamping position. A retaining pin 92, secured on lever 80A, extends into an arcuate recess 64B formed in the end of the elongated vertical cover stop 64. The lower potion of lever 80A defines a pair of cam surfaces 90 and 91 that engage a captured push member 86. When the lever 80A is in the non-clamping position of FIG. 15A, cam surface 90 engages the upper portion of the push member 86. The dimensions between the axis of rotation about shaft 88 and surface 90 is such that the push member 86 is held in a retracted position by resilient metal contact member 82. When lever 80A is rotated 90 degrees as indicated by arrow 102 of FIG. 15B, cam surface 91 is forced to engage the push member. The dimensions between the axis of rotation of shaft 88 and surface 91 is greater than that between the axis and surface 90 so that the push member is forced downward so as to deflect the clamp member 82 to the clamping position, as represented by arrow 100. If a cover assembly 18 is positioned as shown in FIG. 14, the clamp member will engage the lower cover section 18B and will thereby secure the assembly in the proper position during the process of applying the cover assembly to the stack 10. As can best be seen in FIG. 15A, when the clamp member is in the non-clamping position, the extreme edge 82A of the member is disposed above the lower surface 75 of book stop 70 and does not extend past the edge 71 of the stop. Thus, the clamp member will not interfere with placement of the cover section 18B or the stack 10. When in the clamping position, the extreme end 82A of the clamp member extends down below the lower surface 75 towards the receiving surface 42 a sufficient distance so that the flexible member 82 will secure the cover section 18B in place. In addition, the end 82A extends out to, but not past, the edge 71 of the stop so that the end will not contact the edge of the stack 10. The end 82A will have a tendency to form a permanent shallow dimple in the cover section 18A, but the dimple will be less noticeable due to its location at the end of liner sheet 14A (FIG. 1) of stack 10, once the liner sheet is applied to the inside of cover section 18B as shown in FIGS. 8E, 8F and 8G as will be described.

Figure 19:
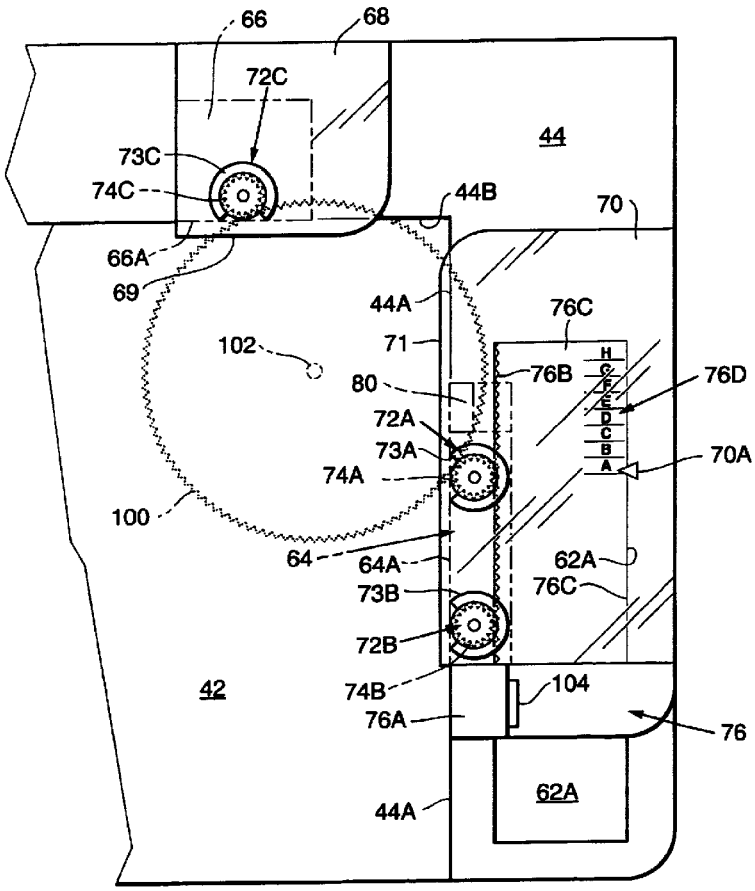
FIG. 19 is a partial plan view of the subject guide apparatus which includes a third spiral cylinder and the associated drive mechanism.
Figure 20:
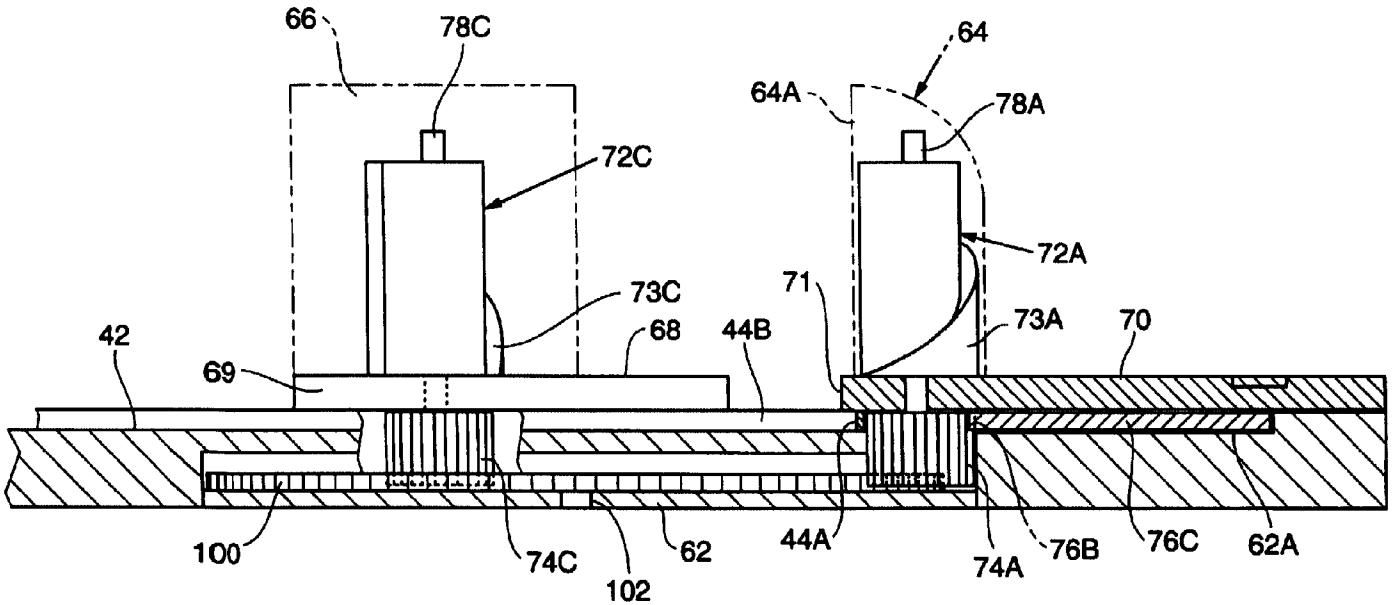
FIG. 20 is a partial elevational view of the FIG. 19 guide apparatus.

As previously noted, spiral cylinders 72A and 72B operate to fully support stack 10 so that the stack will not have a tendency to shingle in the direction normal to the spine of the stack. Although less pronounced, there is also a tendency for the stack to shingle in the direction parallel to the stack spine. FIGS. 19 and 20 depict a portion of a further embodiment of the subject guide apparatus which utilizes a third spiral cylinder 72C which operates to prevent shingling in the direction normal to book stop edge 69 just as cylinders 72A and 72B operate to prevent shingling in the direction normal to book stop edge 71. The rotational position of cylinder 72C is controlled by the same position as that of cylinders 72A and 72B. A large gear 100 is rotationally mounted on the under surface of the base member 62 by way of a spindle 102 and is positioned to engage pinion 74A of cylinder 72A and to engage a pinion gear 74C of third cylinder 72C. Thus, pinion 74A is directly driven by rack member 76B when the rack member is manually moved by a user holding grip member 76A.

As previously described, the final position of rack member 76B is related to the thickness of the stack 10 to be covered. For thin stacks 10, the engaging surfaces 73A and 73B will be completely withdrawn behind surface 64A so that the edge of the stack facing stop 64 is supported only by edge 71, as previously described. Similarly, surface 73C of cylinder 72C will be completely withdrawn so that the edge of the stack facing stop 66 will be supported only by edge 69. For thicker stacks, cylinders 72A and 72B will be rotated such that the respective engaging surfaces 73A and 73B will extend out a distance equal to that of edge 71, with the height of the engaging surfaces extends substantially all the way the top of the stack, as shown in FIG. 18, so as to prevent shingling in one direction. Cylinder 72C will also be rotated the same amount so that engaging surface 73C will extend out a distance equal to that of corresponding edge 69 and will extend up the same height as surfaces 73A and 73B, that is, to the top of the stack so as to prevent shingling in the other direction.

When a stack 10 is inserted intermediate grip member 76A and the edge of stop 64 for measurement as shown in FIG. 16, a locking mechanism is preferably provided to secure the stack in place so that a user has both hands free to work on the stack. By way of example, it is common to apply a fabric head band (not depicted) to the spine of a stack prior to application of a hardcover so as to more closely simulate the appearance of a conventionally bound book. The fabric headband, which is nonfunctional, typically must be hand trimmed to fit the width of the stack and must be applied to the spine using an adhesive, tasks that require the use of both hands. Further, once the head band has been applied, it is desirable that position of the gripping member 76A not change after the stack has been removed and during the process of applying the hardcover assembly 18 to the stack.

Figure 21A:
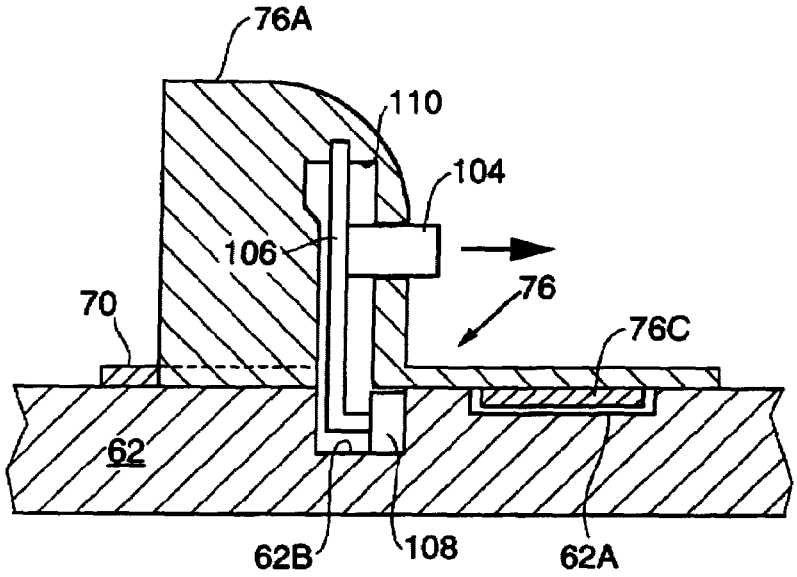
FIGS. 21A and 21B depict an alternative grip member having a locking mechanism in the locked and unlocked position, respectively.
Figure 21B:
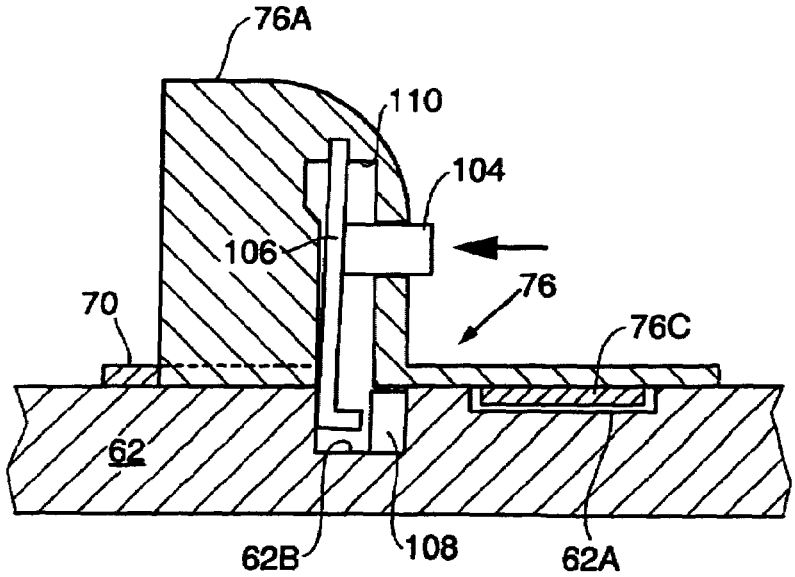

FIGS. 21A and 21B show an alternative grip member 76A having an internal locking mechanism which will lock the grip member so that the member can both initially support the stack and then keep the member from moving, together with the rack member 76B and the pinions driven by the rack member, when the cover assembly 18 is applied to the stack. A cavity 110 is formed in the grip member 76A to receive an elongated metal stop lock 106. Stop lock 106 is secured exclusively at the upper end of the lock, at the top of cavity 110. The L-shaped lower portion of the stop lock extends down into an elongated recess 62B formed in base member 62. An elongated robber lock strip 108 is disposed along one side of recess 62B, facing the L-shaped lower portion of the stop lock 106. The normal position of the stop lock 106 is shown in FIG. 21A, with the L-shaped portion engaging rubber lock strip 108. In this position, the grip member 76A is locked in position relative to base member 62. An actuator member is positioned in an opening (not designated) formed in grip member 76A, with the actuator having one end secured to the stop lock and the other end extending through the opening to the exterior of the member. When a user depresses the actuator 104, the cantilevered stop lock will deflect away from the lock stop 108, as shown in FIG. 21B so that grip member 76A can be translated along its normal path, with the end of the lock stop moving in recess 62B. When the actuator 104 is released by the user as a selected position, the stop lock 106 automatically reengages lock stop 108 thereby locking the grip member 76A at that position.

The method of applying a hardcover assembly 18 to a stack using the second embodiment guide apparatus 60 is similar to the method using the first embodiment apparatus, with significant modifications. The stack 10 is first bound as shown and described in connection with FIG. 2. The edge of the stack 10 is then positioned between grip member 76A and the end of elongated vertical cover stop 64 as shown in FIG. 16 and the grip member is pushed against the stack 10 so that the spacing between the grip member and the stop is equal to the thickness of the stack. If the guide apparatus includes the locking mechanism previously described in connection with FIGS. 21A and 21B, it will be necessary to depress actuator 104 in order to move gripping member 76A. Once positioned correctly, the user can then release the actuator 104 thereby locking the member 76A in place and securing the stack 10 for any additional work that needs to be done such as application of a head band, as previously described. The user then removes the stack 10, leaving the grip member 76A position undisturbed (or locked) and obtains a cover assembly 18 in accordance with the size designated by pointer indicia 70A.

The selected cover assembly 18 is then positioned on the receiving surface 42 of the guide assembly as shown in FIG. 8A, with one edge of the cover section 18B abutting stop member edge 44B (FIG. 11) and another edge of cover section 18B abutting stop member edge 44A. Clamp lever 80A is then depressed as shown in FIG. 14 so that the edge of cover section 18B is clamped down on surface 42 by clamp member 82. This operates to hold the cover assembly 18 in the correct position during the remainder of the process. As shown in FIG. 8B, minor release liner 38B is then manually removed from the cover assembly 18 thereby exposing the underlying pressure activated adhesive. The stack 10 is then positioned over the cover assembly 18, similar to the step shown in FIG. 8C, except edge of stack 10 is positioned abutting edge 69 of book stop 68 and another edge is positioned abutting both edge 71 of stop 70 and surfaces 73A/73B of the spiral cylinders 72A/72B as shown in FIG. 18. Note that the cylinders will have been rotated by slide member 76 to an appropriate position such that surfaces 73A/73B extend almost to the top of the stack 10. Thus, there will be no tendency for the stack to shingle in the direction normal to edge 71. In the event that guide apparatus includes a third spiral cylinder 72C as shown in FIGS. 19 and 20, gear 100 will cause the third cylinder to rotate the appropriate amount so that the presence of surface 73C will prevent stack 10 from shingling in the direction normal to edge 69.

The spine of stack 10 is then forced down on the underlying narrow adhesive strip as shown in FIG. 8D. This will sufficiently secure the stack to the bottom cover section 18B so that the proper alignment between cover section 18B and the stack 10 is maintained.

As shown in FIGS. 8E and 8F, the unsecured portion of stack 10 is lifted away from the cover section 18B a sufficient distance to allow the major release liner 36B to be removed. The cover section 18 should remain clamped during this step and not moved away from its original position as shown in FIG. 8E. Next, the stack 10 is placed back down on the exposed adhesive thereby securing the remainder of stack 10 to cover section 18B. The user then removes minor release liner 38A, as shown in FIG. 8H, so as to expose a thin strip of pressure sensitive adhesive. The cover section 18A is rotated over stack 10 and positioned, in a manner similar to that shown in FIG. 8I, so that one edge of the cover section contacts surface 66A of the vertical cover stop 66 and so that another edge contacts surface 64A of vertical cover stop 64. A portion of the stop member 44, where the spine for all of the different sized hard cover assemblies 18 will be disposed, is slightly indented to form a recessed edge 44C (FIG. 11). This recessed edge is present so that the stop member 44 will not interfere with the spine of the hardcover 18, since the spine tends to extend out slightly when the cover section 18A is folded onto the stack 10. Note that surface 64A is substantially wider than surfaces 50B and 50C of the first embodiment apparatus as shown in FIG. 8I so that only a single stop 64 is required to ensure proper alignment of the relevant edge of cover section 18A. This position is also illustrated in FIG. 18. The use then forces cover section 18A down onto stack 10 along the spine region as shown in FIG. 8J so as to secure a small part of the cover section 18A to the stack so that the proper alignment of the cover section relative to the stack is maintained.

As shown in FIG. 8K, the cover section 18A is then lifted slightly so as to permit major release liner 36A to be removed from the cover section thereby exposing the remainder of the pressure sensitive adhesive on the cover section. This is carried out without permitting the cover section 18A to be completely separated from the stack so as to maintain the correct alignment between the cover section and the stack. The lifted portion of the cover section 18A is then placed back down on the stack 10 as shown in FIG. 8L and pressed down on the stack as shown in FIG. 8M so that the remainder of the stack 10 is secured to the cover section by way of the exposed adhesive. This completes the method of attaching the cover assembly 18 to the stack.

Thus, novel guide apparatus have been disclosed for accurately attaching a cover assembly to a stack so as to produce a book using desktop equipment. Although preferred embodiments of the guide apparatus have been disclosed in some detail, it is to be understood that certain changes can be made by those skilled in the art without departing from the spirit and scope of the invention as defined by the appended claims. By way of example, a single spiral cylinder could be used instead of a pair.

What is claimed is:

1. A guide apparatus for applying a cover to a bound stack of sheets to produce a covered book having first and second cover sections separated by a spine section, said apparatus comprising:

a base unit which includes a book receiving surface, a first reference line disposed along a periphery of said book receiving surface and a second reference line, orthogonal to said first reference line, disposed along a periphery of said book receiving surface;

a first lower cover stop defining a cover engaging surface disposed along the first reference line;

a first upper cover stop defining a cover engaging surface disposed along the first reference line, with the cover engaging surfaces of the first lower and upper cover stops being disposed in a common plane normal to the book receiving surface;

a first book stop defining a stack engaging surface, with said stack engaging surface being disposed at a height relative to the book receiving surface intermediate a height of the respective cover engaging surfaces of the first upper and lower cover stops and with said stack engaging surface extending a first distance past said first reference line towards the book receiving surface;

a second lower cover stop defining a cover engaging surface disposed along the second reference line;

a second upper cover stop defining a cover engaging surface disposed along the second reference line, with the cover engaging surfaces of the first and second cover stops being disposed in a common plane normal to the book receiving surface; and a second book stop defining a stack engaging surface, with said stack engaging surface being disposed at a height relative to the book receiving surface intermediate a height of the respective cover engaging surfaces of the second upper and lower cover stops and with said stack engaging surface extending a second distance past said second reference line towards the book receiving surface, with the guide apparatus being configured such that, when a covered book is produced using the guide apparatus and placed with the first cover section resting on the book receiving surface and the first cover section contacting the cover engaging surface of each of the first and second lower cover stops, the second cover section will contact the cover engaging surface of each of the first and second upper cover stops and the bound stack will contact the stack engaging surface of each of the first and second book stops.

2. The guide apparatus of claim 1 further including a clamping mechanism disposed along the first reference line and including a clamp member that moves between a clamping position where the clamp member extends past the first reference line and a non-clamping position.

3. The guide apparatus of claim 2 wherein the clamping mechanism includes a clamp lever which causes the clamp member to be in the non-clamping position when the lever is in one position and which causes the clamp member to be in the clamping position when the lever is rotated away from the book receiving surface.

4. The guide apparatus of claim 3 wherein the clamping mechanism includes a base member which defines a base member surface which is co-planar with the cover engaging surface of the first upper cover stop.

5. The guide apparatus of claim 4 wherein the one position of the clamp lever is a position normal with respect to the book receiving surface and wherein the clamp lever defines a surface when in the one position which is co-planar with respect to the base member surface.

6. The guide apparatus of claim 5 wherein the clamp mechanism base member is integral with the first upper cover stop.

7. The guide apparatus of claim 1 wherein the first book stop further includes a first adjust mechanism configured to manually adjust a size of the stack engaging surface of the first book stop in a direction normal to the book receiving surface.

8. The guide apparatus of claim 7 wherein the first book stop defines a fixed portion of the stack engaging surface and an adjustable portion of the stack engaging surface, with the adjustable portion being controlled by the first adjust mechanism.

9. The guide apparatus of claim 8 further including a stack thickness guide which includes a stack receiving mechanism configured to receive an edge of a stack of sheets to be covered and wherein the first adjust mechanism is controlled by the stack receiving mechanism so that the size of the adjustable portion of the stack engaging surface is related to a thickness of the stack of sheets.

10. The guide apparatus of claim 9 further including visual markings on said apparatus indicative of a multiplicity of possible stack sizes and a designator for selecting said markings in response to the stack thickness guide.

11. The guide apparatus of claim 10 wherein the stack thickness guide includes a movable member, a position of which is manually adjusted by a user and which controls a relative position of said visual markings and said designator.

12. The guide apparatus of claim 11 wherein said first adjust mechanism is responsive to the position of the movable member.

13. The guide apparatus of claim 12 wherein said first adjust mechanism includes a first rotatable member that defines said adjustable portion of the stack engaging surface, with the size of the adjustable portion being a function of a rotational position of the first rotatable member.

14. The guide apparatus of claim 13 wherein the rotational position of the first rotatable member is controlled by said movable member.

15. The guide apparatus of claim 14 wherein the first rotatable member is substantially disposed within the first upper cover stop.

16. The guide apparatus of claim 14 wherein said first adjust mechanism includes a first pinion mounted for rotation with said first rotatable member and a rack engaging the first pinion that moves with said movable member.

17. The guide apparatus of claim 16 wherein said first adjust mechanism includes a second rotatable member which, together with said first rotatable member, define said adjustable portion of the stack engaging surface, a second pinion mounted for rotation with the second rotatable member, with the rack engaging said first and second pinions.

18. The guide apparatus of claim 17 wherein the first and second rotatable members are substantially disposed within the first upper cover stop.

19. The guide apparatus of claim 16 wherein second book stop further includes a second adjust mechanism configured to manually adjust a size of the stack engaging surface of the second book stop in a direction normal to the book receiving surface.

20. The guide apparatus of claim 19 wherein the second book stop defines a fixed portion of the stack engaging surface, with the adjustable portion being controlled by the second adjust mechanism.

21. The guide apparatus of claim 20 wherein the second adjust mechanism is controlled by the stack receiving mechanism so that the size of the adjustable portion of the stack engaging surface of the second book stop is related to the thickness of the stack of sheets.

22. The guide apparatus of claim 21 wherein the second adjust mechanism includes a second rotatable member that defines said adjustable portion of the stack engaging surface of the second book stop, with the size of the adjustable portion being a function of a rotational position of the second rotatable member.

23. The guide apparatus of claim 22 wherein the first rotatable member is substantially disposed within the first upper cover stop and the second rotatable member is disposed substantially within the second upper cover stop.

24. The guide apparatus of claim 23 wherein the first adjust mechanism includes a third rotatable member which, together with said first rotatable member, define said adjustable portion of the stack engaging surface of the first book stop, with the rotatable position of the first, second and third rotatable members being controlled by said movable member.

25. The guide apparatus of claim 12 wherein the stack thickness guide includes a locking mechanism configured to switch the movable member between a locked position with respect to the base unit and an unlocked position with respect to the base unit.

26. The guide apparatus of claim 25 wherein the locking mechanism is configured to switch the movable member from the lock position to the unlocked position upon manual activation of the locking mechanism by a user and to switch the movable member from the unlocked to the locked position when a user releases the locking mechanism.

27. A guide apparatus for applying a cover to a bound stack of sheets, said apparatus comprising:

a base unit which includes a book receiving surface, a first reference line disposed along a periphery of said book receiving surface and a second reference line, orthogonal to said first reference line, disposed along a periphery of said book receiving surface;

a first lower cover stop defining a cover engaging surface disposed along the first reference line;

a first upper cover stop defining a cover engaging surface disposed along the first reference line, with the cover engaging surfaces of the first lower and upper cover stops being aligned along an axis normal to the book receiving surface;

a first book stop defining a stack engaging surface, with said stack engaging surface being disposed intermediate the cover engaging surfaces of the first upper and lower cover stops and with said stack engaging surface extending a first distance past said first reference line towards the book receiving surface;

a second lower cover stop defining a cover engaging surface disposed along the second reference line;

a second upper cover stop defining a cover engaging surface disposed along the second reference line, with the cover engaging surfaces of the first and second cover stops being aligned along an axis normal to the book receiving surface;

a second book stop defining a stack engaging surface, with said stack engaging surface being disposed intermediate the cover engaging surfaces of the second upper and lower cover stops and with said stack engaging surface extending a second distance past said second reference line towards the book receiving surface;

a clamping mechanism disposed along a selected one of the first and second references lines and including a clamp member that moves between a clamping position where the clamp member extends past the selected reference line and a non-clamping position; and an adjust mechanism configured to manually adjust a size of the stack engaging surface of a selected one of the first and second book stops in a direction normal to the book receiving surface.

28. The guide apparatus of claim 27 wherein the selected one of the first and second book stops defines a fixed portion of the stack engaging surface and an adjustable portion of the stack engaging surface, with the adjustable portion being controlled by the adjust mechanism.

29. The guide apparatus of claim 28 further including a stack thickness guide which includes a stack receiving mechanism configured to receive an edge of a stack of sheets to be covered and wherein the adjust mechanism is controlled by the stack receiving mechanism so that the size of the adjustable portion of the stack engaging surface is related to a thickness of the stack of sheets.

30. The guide apparatus of claim 29 further including visual markings on said apparatus indicative of a multiplicity of possible stack sizes and a designator for selecting said markings in response to the stack thickness guide.

31. The guide apparatus of claim 30 further including a movable member, with the adjust mechanism being responsive to the position of the movable member.

32. The guide apparatus of claim 31 wherein said adjust mechanism includes a first rotatable member that defines said adjustable portion of the stack engaging surface, with the size of the adjustable portion being a function of a rotational position of the first rotatable member.

33. The guide apparatus of claim 32 wherein the rotational position of the first rotatable member is controlled by said movable member.

34. The guide apparatus of claim 33 wherein the first rotatable member is substantially disposed within a selected one of the first and second upper cover stops.

35. The guide apparatus of claim 33 wherein said adjust mechanism includes a first pinion mounted for rotation with said first rotatable member and a rack engaging the first pinion that moves with said movable member.

36. The guide apparatus of claim 35 wherein said adjust mechanism includes a second rotatable member which, together with said first rotatable member, define said adjustable portion of the stack engaging surface, a second pinion mounted for rotation with the second rotatable member, with the rack engaging said first and second pinions.

37. The guide apparatus of claim 36 wherein the first and second rotatable members are substantially disposed within the selected one of the first upper cover stops.

38. The guide apparatus of claim 33 further including a stack thickness guide which includes a stack receiving mechanism configured to receive an edge of a stack of sheets to be covered and includes the movable member which is moved in accordance with the stack thickness.

39. The guide apparatus of claim 38 further including visual markings on said apparatus indicative of a multiplicity of possible stack sizes and a designator for selecting said markings in response to the stack thickness guide.

40. The guide apparatus of claim 39 wherein movement of the movable member by a user controls a relative position of said visual markings and said designator.

41. The guide apparatus of claim 1 the guide apparatus further including a manual adjust mechanism configured to manually add and remove a supplemental stack engaging surface, with the supplemental stack engaging surface being coplanar with the stack engaging surface of the first book stop.

42. The guide apparatus of claim 41 wherein the supplemental stack engaging surface is added at a height above the book receiving surface which is greater than a height of the stack engaging surface of the first book stop above the book receiving surface.

43. The guide apparatus of claim 42 wherein the manual adjust mechanism is further configured to manually vary the height of the supplemental stack engaging surface above the book receiving surface.

44. The guide apparatus of claim 28 wherein the adjust mechanism functions to adjust a size of the stack engaging surface by manually adding and removing a supplemental stack engaging surface, with the supplemental stack engaging surface being coplanar with the stack engaging surface of the selected one of the first and second book stops.

45. The guide apparatus of claim 44 wherein the supplemental stack engaging surface is added at a height above the book receiving surface which is greater than a height of the stack engaging surface of the selected one of the first and second book stops.

46. The guide apparatus of claim 45 wherein the adjust mechanism is further configured to manually vary the height of the supplemental stack engaging surface above the book receiving surface.

47. The guide apparatus of claim 1 wherein the first and second lower cover stops are each positioned abutting the book receiving surface.

48. The guide apparatus of claim 47 the guide apparatus further including a manual adjust mechanism configured to manually add and remove a supplemental stack engaging surface, with the supplemental stack engaging surface being coplanar with the stack engaging surface of the first book stop.

* * * * *

UNITED STATES PATENT AND TRADEMARK OFFICE

CERTIFICATE OF CORRECTION

PATENT NO. : 7,134,822 B2
APPLICATION NO. : 10/385960
DATED : November 14, 2006
INVENTOR(S) : Kevin P. Parker et al.

It is certified that error appears in the above-identified patent and that said Letters Patent is hereby corrected as shown below:

On the title page, Item (75), Inventors: "Wayne Kassom" should be --Wayne Kasom--.

Signed and Sealed this

Twenty-seventh Day of February, 2007

JON W. DUDAS
*Director of the United States Patent and Trademark Office*